US008256142B2

(12) United States Patent
Igdari

(10) Patent No.: US 8,256,142 B2
(45) Date of Patent: Sep. 4, 2012

(54) ANATOMICALLY CORRECT FLEXIBLE CONTOURED FOOTBED INSOLE

(76) Inventor: Sashanaz Hashempour Igdari, San Ramon, CA (US)

( * ) Notice: Subject to any disclaimer, the term of this patent is extended or adjusted under 35 U.S.C. 154(b) by 628 days.

(21) Appl. No.: 12/358,271

(22) Filed: Jan. 23, 2009

(65) Prior Publication Data

US 2009/0193683 A1 Aug. 6, 2009

Related U.S. Application Data

(60) Provisional application No. 61/063,423, filed on Feb. 4, 2008.

(51) Int. Cl.
*A43B 13/18* (2006.01)

(52) U.S. Cl. ..... 36/44; 36/34 R; 36/24.5; 36/102; 36/174; 36/43

(58) Field of Classification Search ..... 36/34 R, 36/24.5, 102, 174, 28, 43, 37, 44, 36 A
See application file for complete search history.

(56) References Cited

U.S. PATENT DOCUMENTS 1,730,466 A * 10/1929 Mallott ..... 36/140
2,185,526 A * 1/1940 Silver ..... 36/163
2,863,231 A * 12/1958 Henry ..... 36/174
4,320,588 A * 3/1982 Sottolana ..... 36/24.5
4,756,096 A * 7/1988 Meyer ..... 36/44
4,841,647 A * 6/1989 Turucz ..... 36/44
4,876,805 A 10/1989 Peoples
5,063,692 A * 11/1991 Suginaka ..... 36/43
5,542,196 A * 8/1996 Kantro ..... 36/44
5,896,677 A * 4/1999 Barsorian ..... 36/11.5
6,453,578 B1 * 9/2002 Yung et al. ..... 36/43
6,510,626 B1 * 1/2003 Greenawalt ..... 36/43
6,631,568 B2 * 10/2003 Howlett et al. ..... 36/43
D487,185 S * 3/2004 Grisoni et al. ..... D2/961
6,880,266 B2 * 4/2005 Schoenborn et al. ..... 36/28
7,062,866 B2 6/2006 Bussler
D532,586 S * 11/2006 Birkenstock ..... D2/961
7,322,130 B2 * 1/2008 Seiter ..... 36/44
7,380,353 B2 * 6/2008 Feller et al. ..... 36/76 R
7,610,696 B2 * 11/2009 Davis ..... 36/43
7,721,467 B2 * 5/2010 Cheskin et al. ..... 36/44
7,832,119 B2 * 11/2010 Gilmore ..... 36/44
7,854,075 B2 * 12/2010 Kosmas ..... 36/44

(Continued)

FOREIGN PATENT DOCUMENTS

EP 1433396 A1 9/1997

*Primary Examiner* — Laurie Cranmer
(74) *Attorney, Agent, or Firm* — Ash Tankha; Lipton, Weinberger & Husick

(57) ABSTRACT

Disclosed herein is a flexible contoured footbed insole for footwear for providing an anatomically correct foot support to a wearer of the footwear. The flexible contoured footbed insole comprises a heel section and a support system extending anteriorly from the heel section. The heel section comprises a cup shaped structure for accommodating a heel of a foot of the wearer. The support system comprises an inner longitudinal arch support, an outer longitudinal arch support, a transverse arch support, a metatarsal arch support, and a toe support for supporting an inner longitudinal arch, an outer longitudinal arch, a transverse arch, a metatarsal arch, and toes of the foot of the wearer respectively. The flexible contoured footbed insole may further comprise a flexible structure disposed within the support system. The flexible structure provides flexibility and freedom of movement to the foot of the wearer.

15 Claims, 20 Drawing Sheets

U.S. PATENT DOCUMENTS

2002/0007569 A1* 1/2002 Crane et al. ..... 36/44
2003/0110662 A1* 6/2003 Gilman et al. ..... 36/43
2003/0145487 A1* 8/2003 Hong ..... 36/3 R
2004/0078998 A1* 4/2004 Davis et al. ..... 36/44
2004/0118017 A1* 6/2004 Dalton et al. ..... 36/44
2004/0181976 A1* 9/2004 Copeskey et al. ..... 36/145
2004/0211086 A1 10/2004 Dananberg
2005/0050771 A1* 3/2005 Dananberg ..... 36/43
2007/0017120 A1* 1/2007 Huang ..... 36/3 B
2008/0005933 A1* 1/2008 Auger et al. ..... 36/97
2008/0148599 A1* 6/2008 Collins ..... 36/44
2008/0216350 A1* 9/2008 Lindqvist et al. ..... 36/43
2008/0216357 A1* 9/2008 Fogg et al. ..... 36/25 R
2008/0229612 A1* 9/2008 Sommer et al. ..... 36/44
2010/0180467 A1* 7/2010 Singleton ..... 36/88
2010/0186257 A1* 7/2010 Karl et al. ..... 36/44

* cited by examiner

ANATOMICALLY CORRECT FLEXIBLE CONTOURED FOOTBED INSOLE

CROSS REFERENCE TO RELATED APPLICATIONS

This application claims the benefit of provisional patent application number U.S. 61/063,423 titled "Anatomically Correct High Heel Flexible Footbed Insole", filed on Feb. 4, 2008 in the United States Patent and Trademark Office.

BACKGROUND

This invention, in general, relates to an insole for footwear. More particularly, this invention relates to a flexible contoured footbed insole for use with footwear of a wide range of heel heights and also for footwear without high heels, for providing an anatomically correct foot support to a wearer of the footwear.

High heeled footwear is typically uncomfortable to the wearer and may cause discomfort and pain to the wearer. Some high heeled footwear may provide some comfort to the foot of the wearer by providing soft padding inside the footwear. However, the soft padding may not be anatomically correct and does not provide proper support to the arches of the foot.

Typical high heeled footwear provides little or no anatomically correct foot support. The footbed insoles inside high heeled footwear do not provide structural rigidity and support, or do not enable freedom of movement of the wearer's foot. Arches of the wearer's foot may be strained due to lack of structural support, causing pain and discomfort to the wearer. The heel of the foot may slip and slide off the center of the footwear due to lack of heel support, thereby causing foot stress. The risk of the wearer of high heeled footwear suffering ankle injury may be increased due to lack of heel support. The toes and ball of the foot may be unsupported by the footwear and may slip off the footwear due to the steep incline created by elevation of the heel of the foot by the high heeled footwear.

Hence, there is a need for a flexible contoured footbed insole for footwear that provides an orthopedically and anatomically correct foot support to a wearer of the footwear and that provides freedom of movement to the wearer's foot.

SUMMARY OF THE INVENTION

This summary is provided to introduce a selection of concepts in a simplified form that are further described in the detailed description of the invention. This summary is not intended to identify key or essential inventive concepts of the claimed subject matter, nor is it intended for determining the scope of the claimed subject matter.

The flexible contoured footbed insole for footwear disclosed herein addresses the above mentioned need for providing an orthopedically and anatomically correct foot support to a wearer of the footwear. The flexible contoured footbed insole comprises a heel section and a support system. The heel section comprises a cup shaped structure for accommodating a heel of the wearer's foot. The heel section may further comprise a first cushioning structure for providing comfort and shock absorbance to the heel of the wearer's foot. The first cushioning structure is located in the cup shaped structure of the heel section.

The support system extends anteriorly from the heel section. The support system supports the inner longitudinal arch, outer longitudinal arch, transverse arch, metatarsal arch, and toes of the wearer's foot. The support system may comprise an inner longitudinal arch support, an outer longitudinal arch support, a transverse arch support, a metatarsal arch support, and a toe support. The inner longitudinal arch runs along the inside of the wearer's foot from the ball of the foot to the heel of the foot. The inner longitudinal arch support supports the inner longitudinal arch of the wearer's foot. The inner longitudinal arch supports the wearer's body weight and when supported adequately helps distribute the weight evenly between the ball and heel of the wearer's foot, thereby relieving excess pressure exerted on the ball of the wearer's foot when wearing high heeled footwear.

The outer longitudinal arch runs along the outside of the wearer's foot. The outer longitudinal arch support is disposed adjacent to the inner longitudinal arch support and supports the outer longitudinal arch of the wearer's foot. The outer longitudinal arch support is rigid and stabilizes the wearer's foot while bearing weight of the wearer's body. The transverse arch is situated across the heel of the wearer's foot behind the in-step. The transverse arch is the first arch to make contact with the ground during walking, thereby acting as a shock absorber for the wearer's body. The transverse arch support extends posteriorly from the inner longitudinal arch support and the outer longitudinal arch support. The transverse arch support supports the transverse arch of the wearer's foot.

The metatarsal arch is formed by the five metatarsal heads across the ball of the wearer's foot. The metatarsal arch support extends anteriorly from the inner longitudinal arch support and the outer longitudinal arch support. The metatarsal arch support stabilizes the five metatarsal heads of the foot. The toe support extends anteriorly from the metatarsal arch support and supports the toes of the wearer's foot. The toe support may comprise a raised toe bar section at a location corresponding to an area between the ball and the toes of the wearer's foot for preventing the foot of the wearer from sliding forward. The raised toe bar section provides a raised physical barrier which prevents the wearer's foot from sliding forward due to the steep incline of the high heeled footwear.

The flexible contoured footbed insole may further comprise a flexible structure. The flexible structure is disposed within the support system. The flexible structure is disposed at a section that links the metatarsal arch support and the toe support. The flexible structure provides flexibility and freedom of movement to the wearer's foot. The flexible contoured footbed insole may further comprise a second cushioning structure between the metatarsal arch support and the toe support for providing comfort and shock absorbance to the ball of the wearer's foot. A lining is disposed along the upper surface of the flexible contoured footbed insole for providing a contact surface for the wearer's foot. The flexible contoured footbed insole may be made of a moisture absorbing material with a non-slippery surface texture for absorbing moisture produced by the foot. The non-slippery surface texture of the moisture absorbing material prevents the wearer's foot from sliding away from a position comfortable to the wearer. The moisture absorbing material is pliable and compressed under the weight of the wearer for accommodating unique contours of the wearer's foot.

BRIEF DESCRIPTION OF THE DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and instrumentalities disclosed herein.

DETAILED DESCRIPTION OF THE INVENTION

For purposes of illustration, a detailed description of a flexible contoured footbed insole for high heeled footwear is provided herein. However, the scope of the flexible contoured footbed insole disclosed herein is not limited to an insole for use with high heeled footwear but may be extended to include a flexible contoured footbed insole for use with a wide range of heel heights, including footwear without high heels.

Figure 1A:
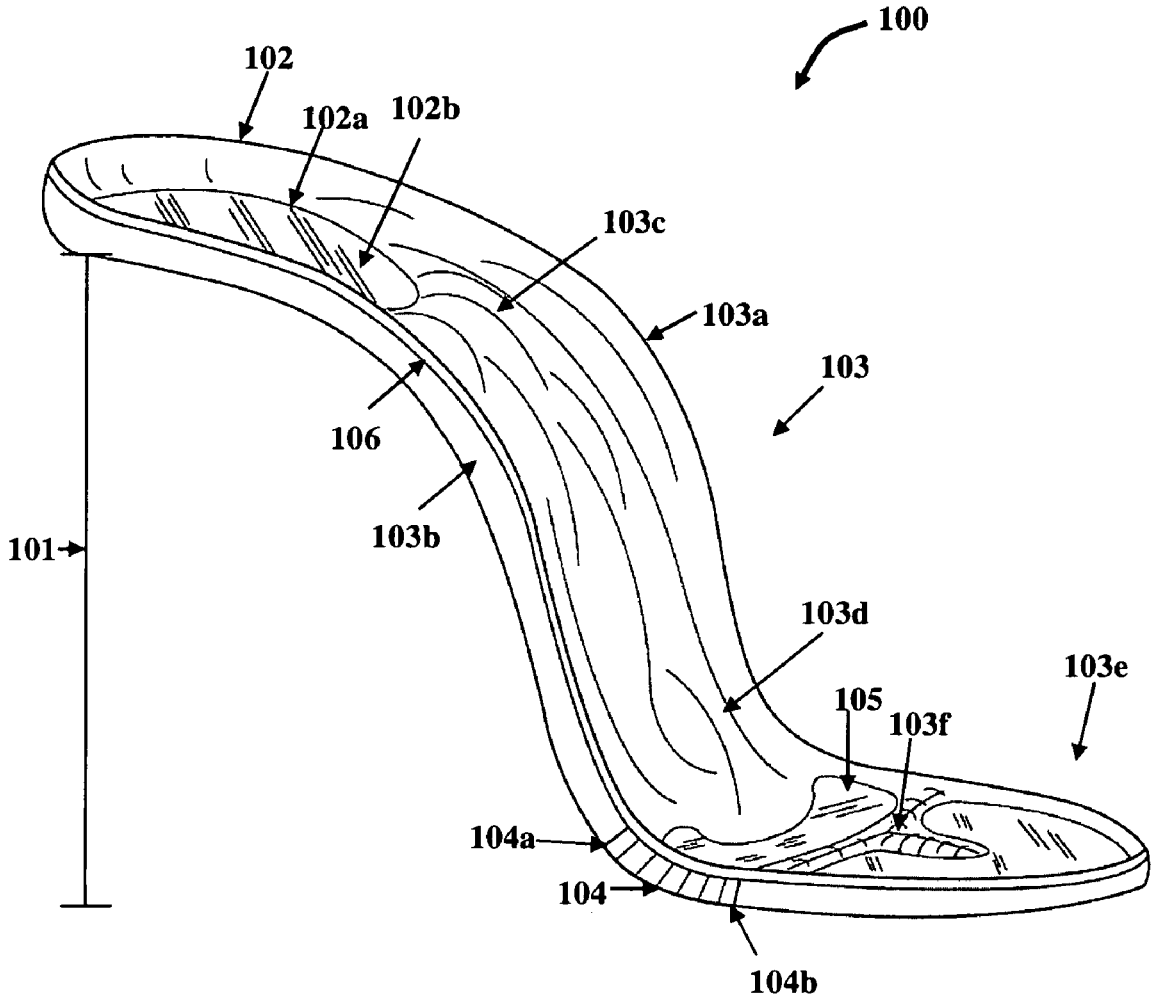
FIG. 1A exemplarily illustrates a flexible contoured footbed insole for use with high heeled footwear, for providing an anatomically correct foot support to a wearer of the high heeled footwear.
Figure 3:
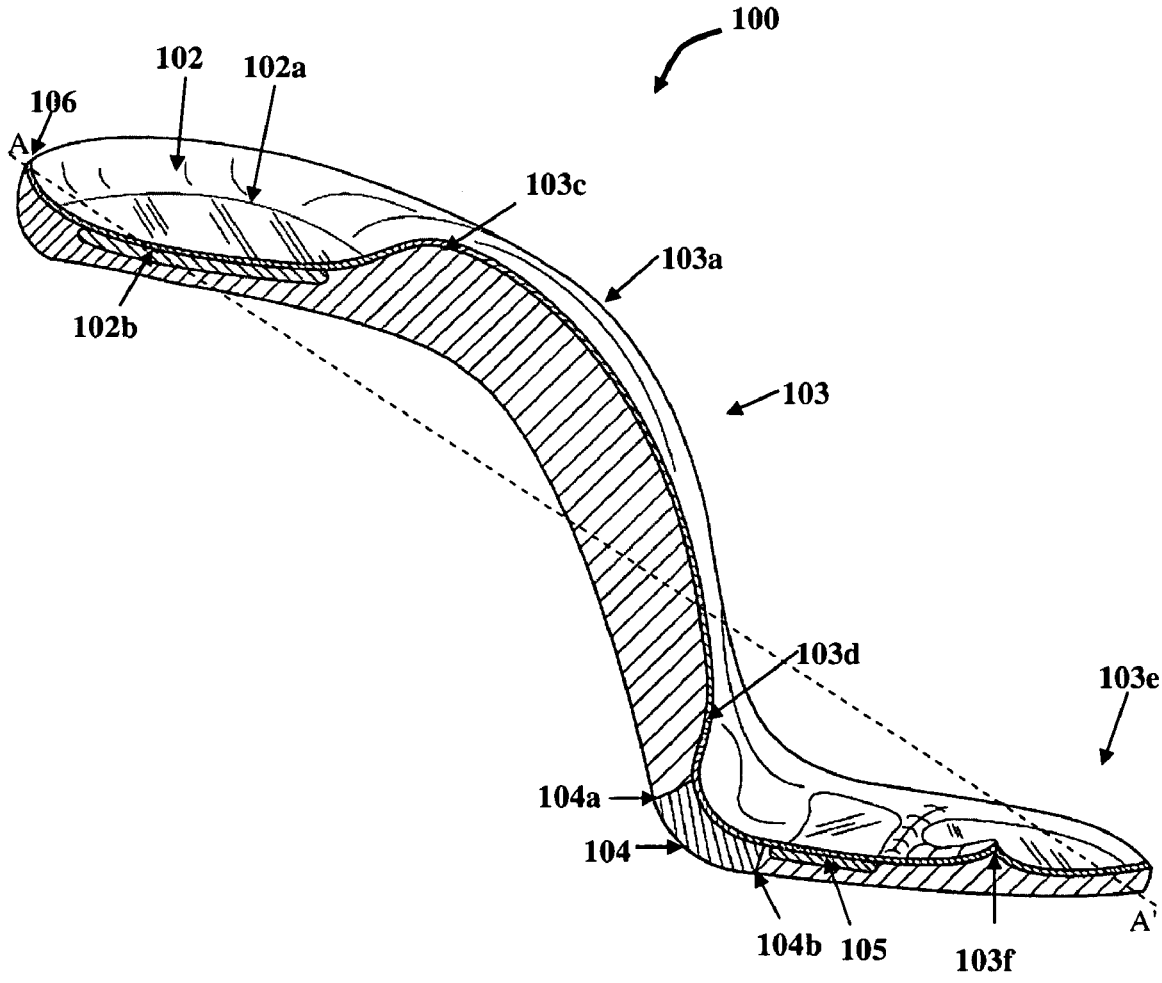
FIG. 3 exemplarily illustrates a side sectional view of the flexible contoured footbed insole for use with high heeled footwear.
Figure 4:
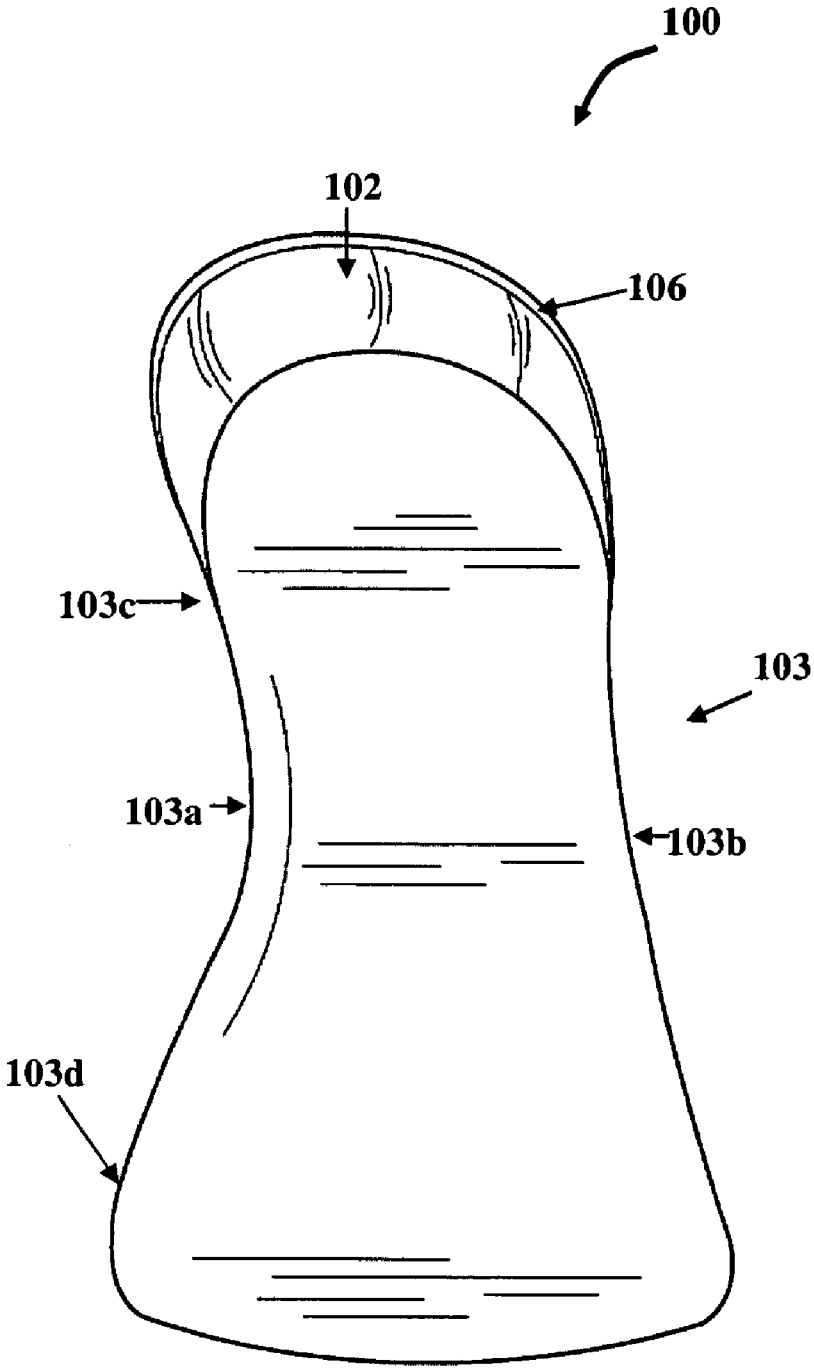
FIG. 4 exemplarily illustrates a rear view of the flexible contoured footbed insole for use with high heeled footwear.

FIG. 1A exemplarily illustrates a flexible contoured footbed insole 100 for use with high heeled footwear, for providing an anatomically correct foot support to a wearer of the high heeled footwear. As used herein, the term "anatomically correct foot support" refers to a foot support adaptable to the contours of a foot 1201 of the wearer. The flexible contoured footbed insole 100 comprises a heel section 102 and a support system 103. A front view of the flexible contoured footbed insole 100 for use with high heeled footwear is exemplarily illustrated in FIG. 2. A side sectional view of the flexible contoured footbed insole 100 taken along the sectional line AA' illustrated in FIG. 2, is exemplarily illustrated in FIG. 3. A rear view of the flexible contoured footbed insole 100 for use with high heeled footwear is exemplarily illustrated in FIG. 4. The heel section 102 of the flexible contoured footbed insole 100 may be raised, for example, to a height 101 of 4 inches or more to be used with footwear with heels of a height of 4 inches or more. The flexible contoured footbed insole 100 may also be manufactured for use with a wide range of heel heights, for example, heels 1 inch in height to heels 4 inches in height. The flexible contoured footbed insole 100 for high heeled footwear with an alternative design of the heel section 102 is exemplarily illustrated FIG. 1B. The flexible contoured footbed insole 100 may also be manufactured for use with flat footwear, as exemplarily illustrated in FIG. 11. The flexible contoured footbed insole 100 may be detachably attached to the footwear based on the wearer's need.

Figure 12:
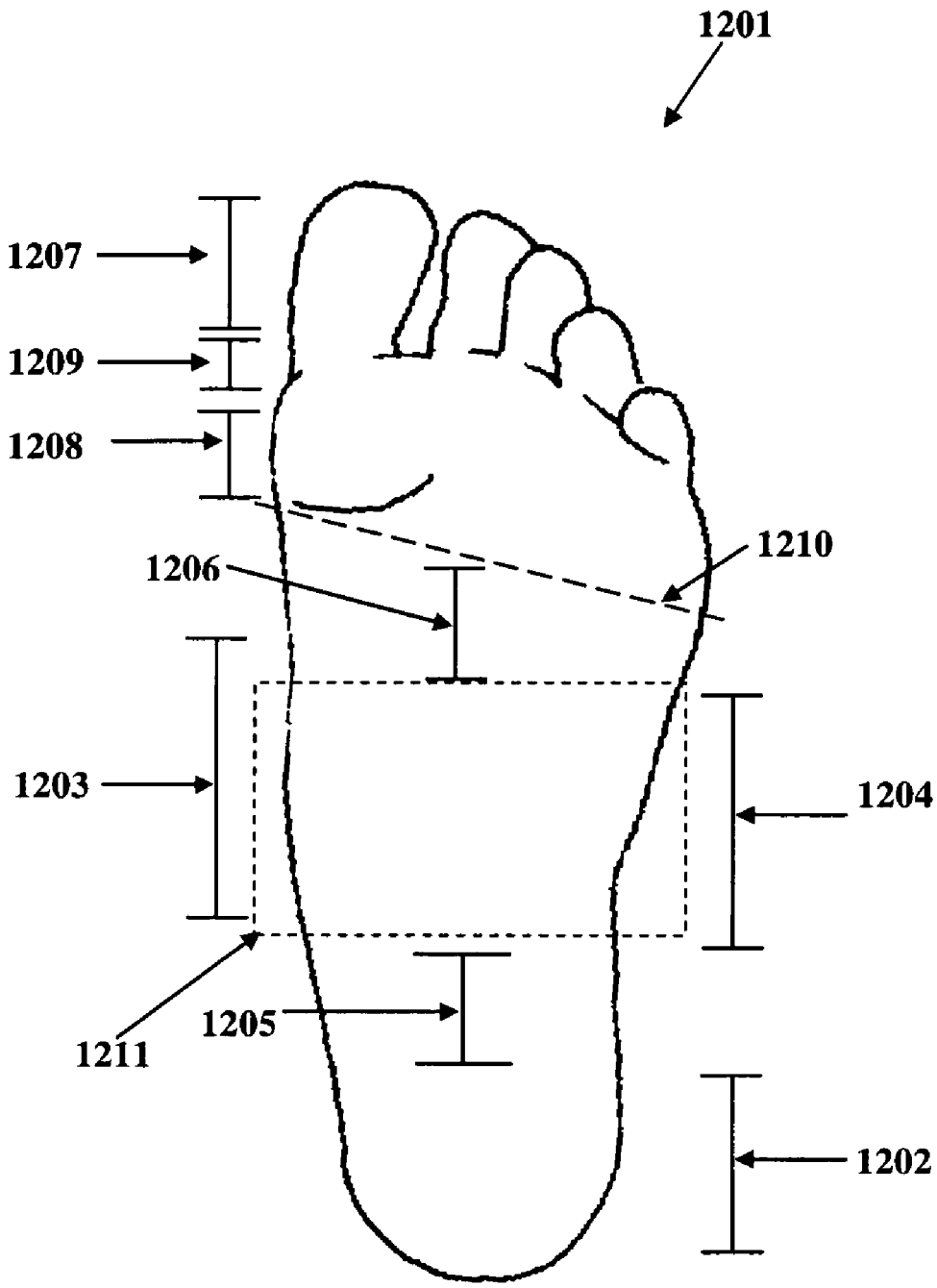
FIG. 12 exemplarily illustrates a bottom view of the anatomy of the foot of the wearer illustrating different sections of the foot.

A bottom view of the anatomy and contours of the wearer's foot 1201 illustrating different sections of the foot 1201 is exemplarily illustrated in FIG. 12. The foot 1201 comprises a heel 1202, an inner longitudinal arch 1203, an outer longitudinal arch 1204, a transverse arch 1205, a metatarsal arch 1206, toes 1207, a ball 1208, and an area 1209 between the toes 1207 and the ball 1208 of the foot 1201. The inner longitudinal arch 1203 and the outer longitudinal arch 1204 together form the waist 1211 of the foot 1201. FIG. 12 further illustrates an area 1210 between ball 1208 and waist 1211 of the wearer's foot 1201 corresponding to which a flexible structure 104 may be provided on the flexible contoured footbed insole 100.

Figure 1B:
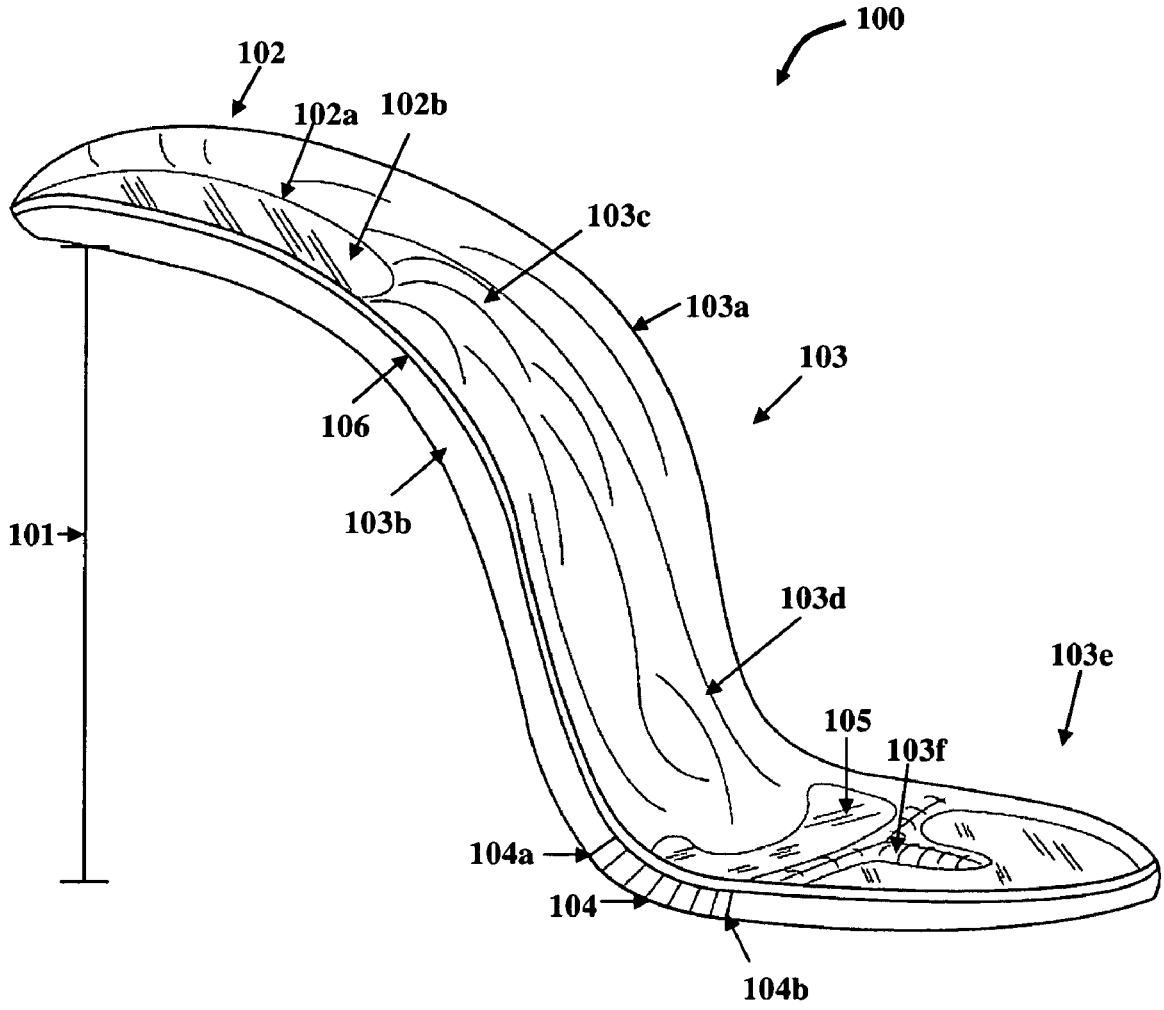
FIG. 1B exemplarily illustrates a flexible contoured footbed insole of high heeled footwear, with an alternative design of the heel section.
Figure 2:
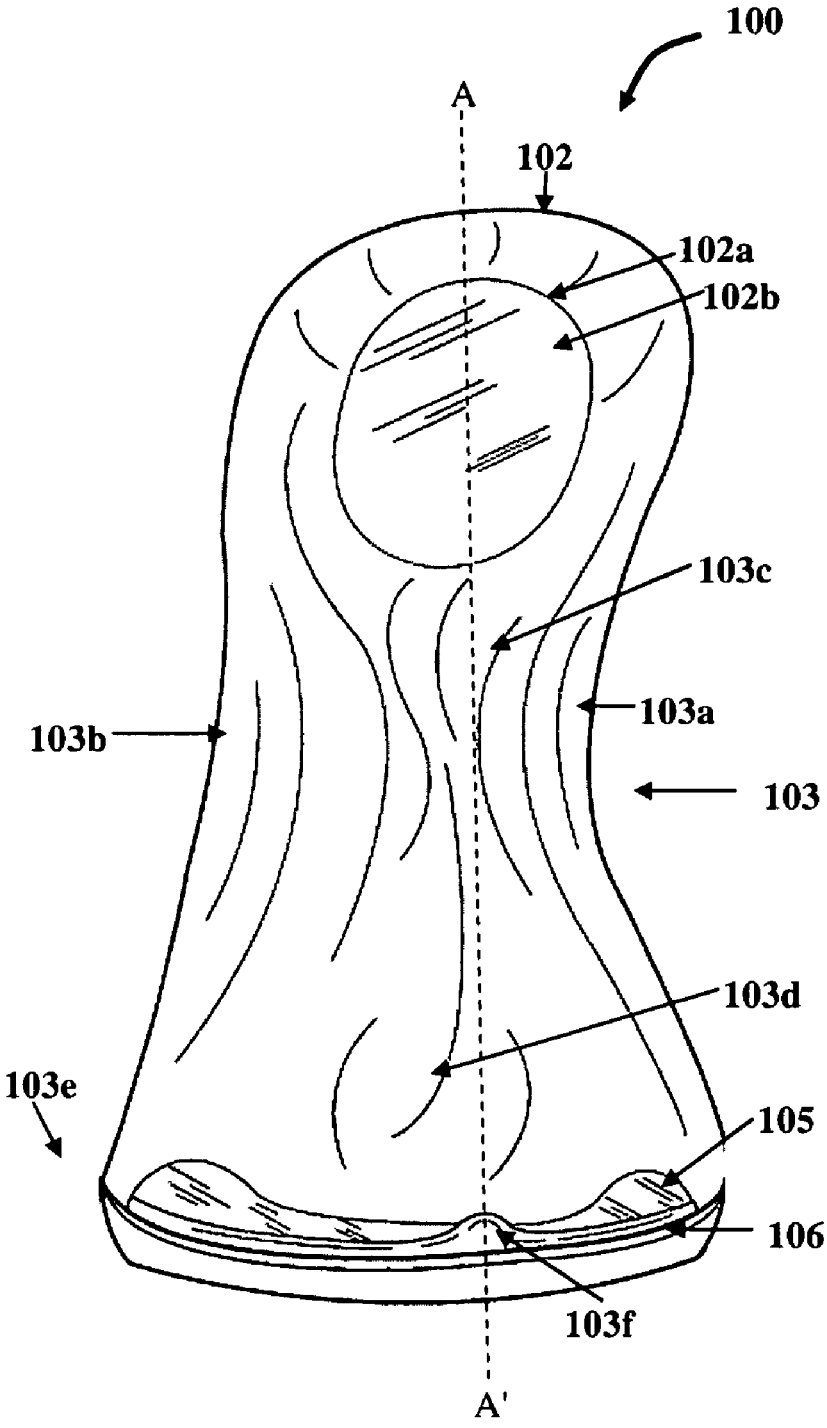
FIG. 2 exemplarily illustrates a front view of the flexible contoured footbed insole for use with high heeled footwear.

As illustrated in FIG. 1A, FIG. 1B, and FIG. 2, the heel section 102 comprises a cup shaped structure 102*a* for accommodating a heel 1202 of the wearer's foot 1201. At the heel section 102, the flexible contoured footbed insole 100 is recessed in a concave shape to accommodate the convex contour of the heel 1202 of the wearer's foot 1201. The cup shaped structure 102*a* prevents the heel 1202 of the foot 1201 from slipping off center of the flexible contoured footbed insole 100. Slipping of the foot 1201 may cause injuries to the foot 1201. The cup shaped structure 102*a* therefore protects the foot 1201 from these injuries. The cup shaped structure 102*a* may be molded to an appropriate depth to provide enhanced stability of the heel 1202 of the foot 1201. The cup shaped structure 102*a* also prevents displacement of the heel 1202 of the foot 1201 from directly under the ankle of the foot 1201, thereby preventing discomfort to the wearer caused by the displacement. The cup shaped structure 102*a*, illustrated in FIG. 1A may provide a bulky appearance to the posterior end of the heel section 102. The bulky appearance may be overcome by providing stylized fabrics over the cup shaped structure 102*a*. An alternative design of the cup shaped structure 102*a* is exemplarily illustrated in FIG. 1B. In the alternative design illustrated in FIG. 1B, the posterior wall of the cup shaped structure 102*a* is removed for an enhanced aesthetic appearance for some styles of footwear. The alternative design provides a less bulky posterior appearance while still maintaining the functionality of the cup shaped structure 102*a*.

The heel section 102 may further comprise a first cushioning structure 102*b* for providing comfort and shock absorbance to the heel 1202 of the wearer's foot 1201. The first cushioning structure 102*b* is located in the cup shaped structure 102*a* of the heel section 102. The first cushioning structure 102*b* comprises a soft padding under the heel 1202 of the foot 1201 for ensuring comfort and shock absorbance, thereby easing pressure on ankles, knees, hips, and spine of the wearer.

The support system 103 extends anteriorly from the heel section 102. The support system 103 supports an inner longitudinal arch 1203, an outer longitudinal arch 1204, a transverse arch 1205, a metatarsal arch 1206, and toes 1207 of the wearer's foot 1201. The support system 103 may comprise an inner longitudinal arch support 103*a*, an outer longitudinal arch support 103*b*, a transverse arch support 103*c*, a metatarsal arch support 103*d*, and a toe support 103*e*. A top view of the flexible contoured footbed insole 100 for use with high heeled footwear illustrating the support system 103 and the heel section 102 is exemplarily illustrated in FIG. 8.

The transverse arch support 103*c*, the inner longitudinal arch support 103*a*, the outer longitudinal arch support 103*b*, and the metatarsal arch support 103*d* are contiguous sections of the flexible contoured footbed insole 100. The transverse arch support 103*c* lies proximate to the heel section 102. The transverse arch support 103*c* is located downstream of the heel section 102 and upstream of the inner longitudinal arch support 103*a* and the outer longitudinal arch support 103*b*. The inner longitudinal arch support 103*a* and the outer longitudinal arch support 103*b* lie side by side and are located downstream of the transverse arch support 103*c*. The inner longitudinal arch support 103*a* and the outer longitudinal arch support 103*b* lie between the transverse arch support 103*c* and the metatarsal arch support 103*d*.

The metatarsal arch support 103*d* is proximate to the inner longitudinal arch support 103*a* and the outer longitudinal arch support 103*b*. The metatarsal arch support 103*d* is located downstream of the inner longitudinal arch support 103*a* and the outer longitudinal arch support 103*b* and upstream of the toe support 103*e*. The toe support 103*e* is proximate to and located downstream of the metatarsal arch support 103*d* and forms the frontal section of the flexible contoured footbed insole 100.

The inner longitudinal arch 1203 runs along the inside of the wearer's foot 1201 from the ball 1208 of the foot 1201 to the heel 1202 of the foot 1201. The inner longitudinal arch support 103*a* is a section of the flexible contoured footbed insole 100 contoured to the shape of the inner longitudinal arch 1203 of the wearer's foot 1201. The inner longitudinal arch support 103*a* is designed to accommodate the inner longitudinal arch 1203 of the wearer's foot 1201 when the wearer is standing or resting her weight on the high heeled or flat footwear. The inner longitudinal arch support 103*a* supports and stabilizes the inner longitudinal arch 1203 of the wearer's foot 1201 and prevents the inner longitudinal arch 1203 from collapsing. The inner longitudinal arch support 103*a* aids in distribution of weight of the wearer evenly from the heel 1202 to the ball 1208 of the foot 1201. The inner longitudinal arch 1203 of the foot 1201 may experience increased stress when the wearer wears high heeled footwear due to extension of the arch. The inner longitudinal arch support 103*a* provides support to alleviate the increased stress experienced due to the wearing of the high heeled footwear. The inner longitudinal arch support 103*a* may also provide comfort and shock absorbance to the inner longitudinal arch 1203 of the foot 1201.

The outer longitudinal arch support 103*b* is disposed adjacent to the inner longitudinal arch support 103*a*. The outer longitudinal arch 1204 runs along the outside of the wearer's foot 1201. The outer longitudinal arch support 103*b* is a section of the flexible contoured footbed insole 100 contoured to the shape of the outer longitudinal arch 1204 of the wearer's foot 1201. The outer longitudinal arch support 103*b* is designed to accommodate the outer longitudinal arch 1204 of the wearer's foot 1201 when the wearer is standing or resting her weight on the high heeled or flat footwear. The outer longitudinal arch support 103*b* supports the outer longitudinal arch 1204 of the wearer's foot 1201. The outer longitudinal arch support 103*b* is rigid and stabilizes the wearer's foot 1201 and supports partial weight of the wearer. The outer longitudinal arch support 103*b* therefore provides support to the weight of the wearer's body.

The transverse arch support 103*c* extends posteriorly from the inner longitudinal arch support 103*a* and the outer longitudinal arch support 103*b*. The transverse arch 1205 is situated across the heel 1202 of the wearer's foot 1201 behind the in-step. The transverse arch support 103*c* is a section of the flexible contoured footbed insole 100 contoured to the shape of the transverse arch 1205 of the wearer's foot 1201. The transverse arch support 103*c* is designed to accommodate the transverse arch 1205 of the wearer's foot 1201 when the wearer is standing or resting her weight on the high heeled or flat footwear. The transverse arch support 103*c* supports the transverse arch 1205 of the wearer's foot 1201. The transverse arch 1205 is the first arch of the wearer's foot 1201 to make contact with the ground during walking, thus it acts as a shock absorber for the wearer's body. The transverse arch support 103*c* therefore has shock absorbing properties for supporting the transverse arch 1205.

The metatarsal arch support 103*d* extends anteriorly from the inner longitudinal arch support 103*a* and the outer longitudinal arch support 103*b*. The metatarsal arch support 103*d* is a section of the flexible contoured footbed insole 100 contoured to the shape of the metatarsal arch 1206 of the wearer's foot 1201. The metatarsal arch support 103*d* is designed to accommodate the metatarsal arch 1206 of the wearer's foot 1201 when the wearer is standing or resting her weight on the high heeled or flat footwear. The metatarsal arch 1206 comprises five metatarsal heads forming the intermediate part of the foot 1201 between the toes 1207 and the heel 1202. The five metatarsal heads collectively form the metatarsus of the wearer's foot 1201. The wearer's metatarsus may be subjected to pain and discomfort during walking. The metatarsal arch support 103*d* stabilizes the metatarsal heads of the wearer's foot 1201. The metatarsal arch support 103*d* provides relief from the pain and discomfort to the metatarsus suffered by the wearer.

Figure 8:
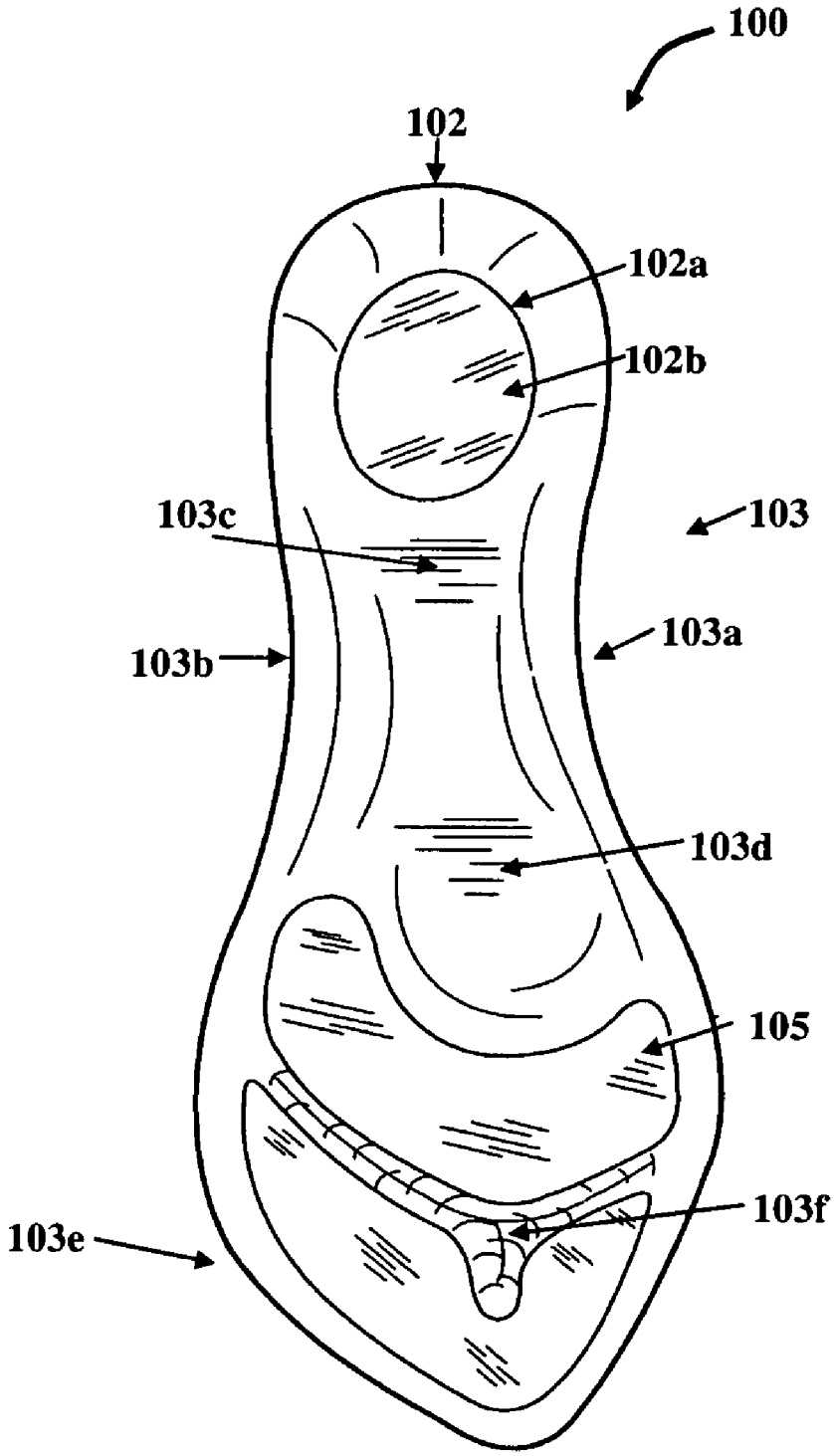
FIG. 8 exemplarily illustrates a top view of the flexible contoured footbed insole for use with high heeled footwear.

The toe support 103*e* is a section of the flexible contoured footbed insole 100 designed to accommodate the toes 1207 of the wearer's foot 1201 when the wearer is standing or resting her weight on the high heeled or flat footwear. The toe support 103*e* extends anteriorly from the metatarsal arch support 103*d*. The toe support 103*e* supports the toes 1207 of the wearer's foot 1201. The toe support 103*e* ensures appropriate posture of the toes 1207. The toe support 103*e* may comprise a raised toe bar section 103*f* for preventing the foot 1201 from sliding forward. The raised toe bar section 103*f* is provided on the flexible contoured footbed insole 100 at a location corresponding to an area 1209 between the ball 1208 and the toes 1207 of the wearer's foot 1201, as illustrated in FIG. 8. The raised toe bar section 103*f* is contoured to fit the area 1209 of the wearer's foot 1201. When the wearer wears high heeled footwear, the wearer's foot 1201 may be pushed forward due to a steep incline created by elevation of the heel 1202 of the foot 1201 with respect to the toes 1207. The raised toe bar section 103*f* forms a physical barrier to the ball 1208 of the foot 1201, thereby preventing the foot 1201 from sliding forward. The raised toe bar section 103*f* may be provided on the flexible contoured footbed insole 100 for use with thong style footwear or non-thong style footwear. The toe support 103*e* may be ergonomically designed to accommodate the toes 1207 of the foot 1201 and to provide comfort to the wearer. The toe support 103*e* may also be narrowly tapered for an aesthetically enhanced design.

The flexible contoured footbed insole 100 may further comprise a second cushioning structure 105, as exemplarily illustrated in FIG. 8, between the metatarsal arch support 103*d* and the toe support 103*e* for providing comfort and shock absorbance to the ball 1208 of the wearer's foot 1201. The second cushioning structure 105 may provide a soft padding under the ball 1208 of the foot 1201 for ensuring comfort and shock absorbance. The first cushioning structure 102*b* and the second cushioning structure 105 may be made of a soft and lightweight foam material, for example, Poron® foam. Poron® foam is an open-celled breathing material that wicks away moisture and has urethanes to provide shock absorbance. The foam material may be an antimicrobial material for inhibiting the growth of odor-causing bacteria and fungus.

Figure 5:
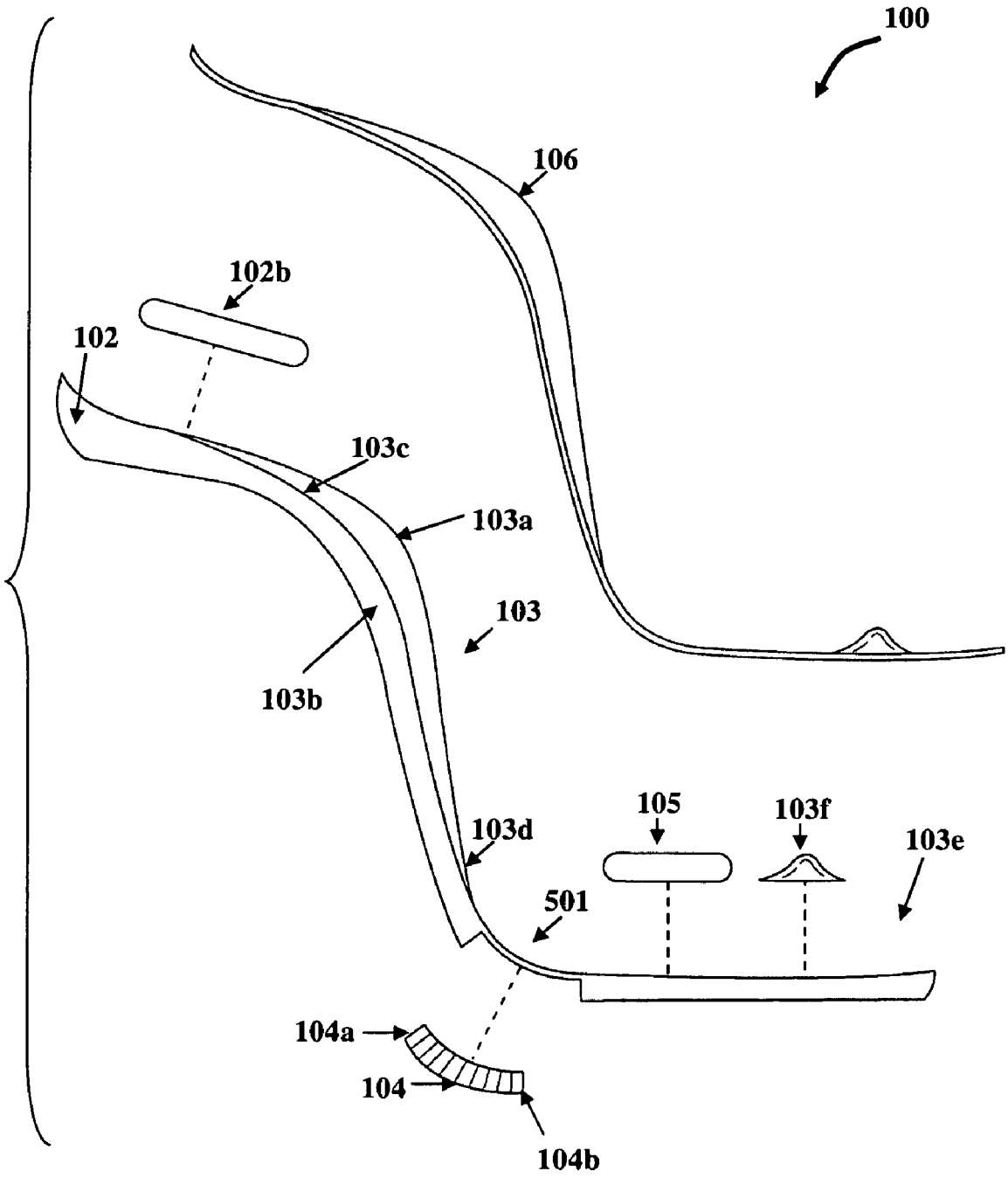
FIG. 5 exemplarily illustrates an exploded side view of the flexible contoured footbed insole for use with high heeled footwear.
Figure 6:
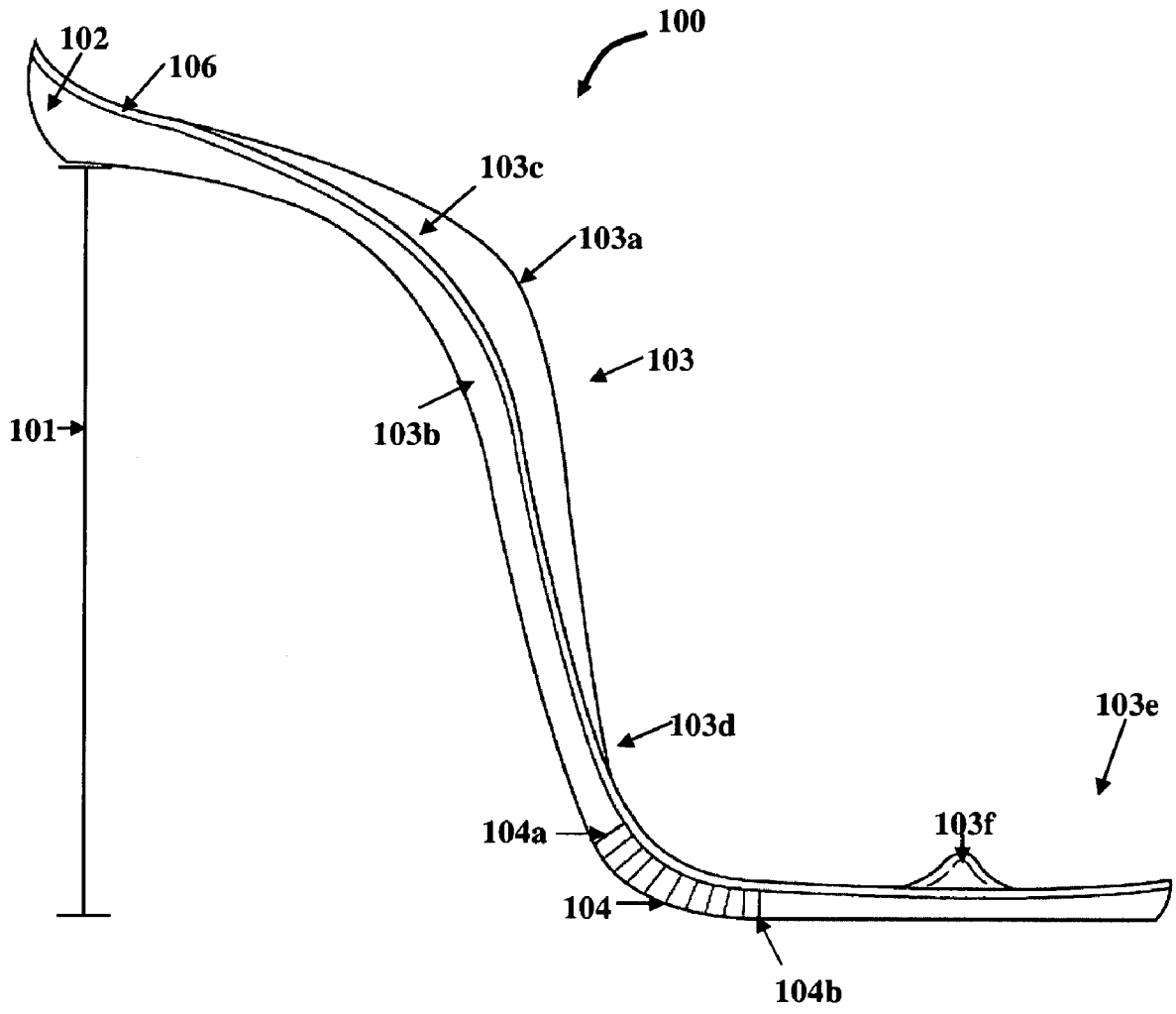
FIGS. 6-7 exemplarily illustrate side views of the flexible contoured footbed insole for use with high heeled footwear.
Figure 7:
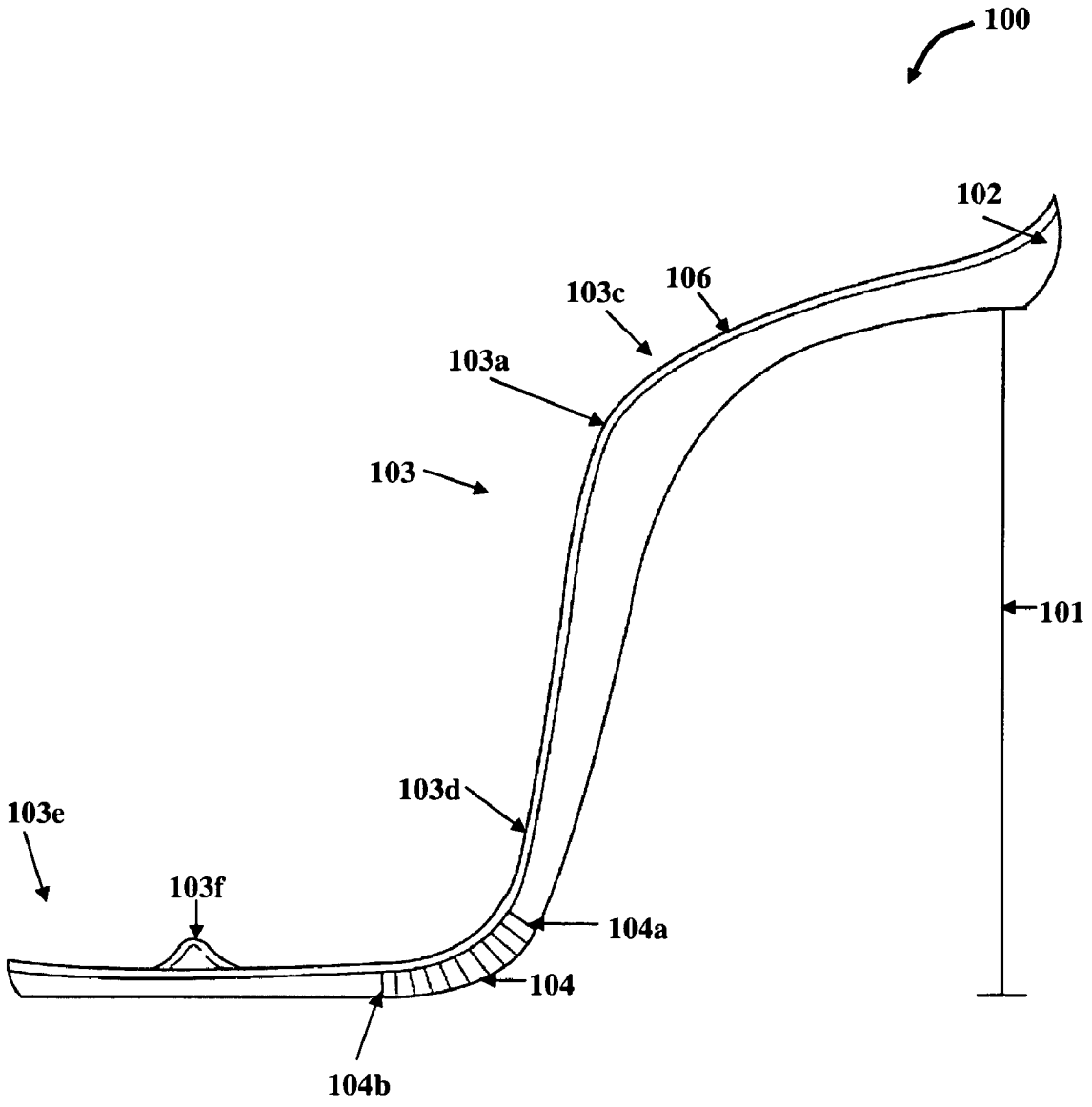
Figure 9:
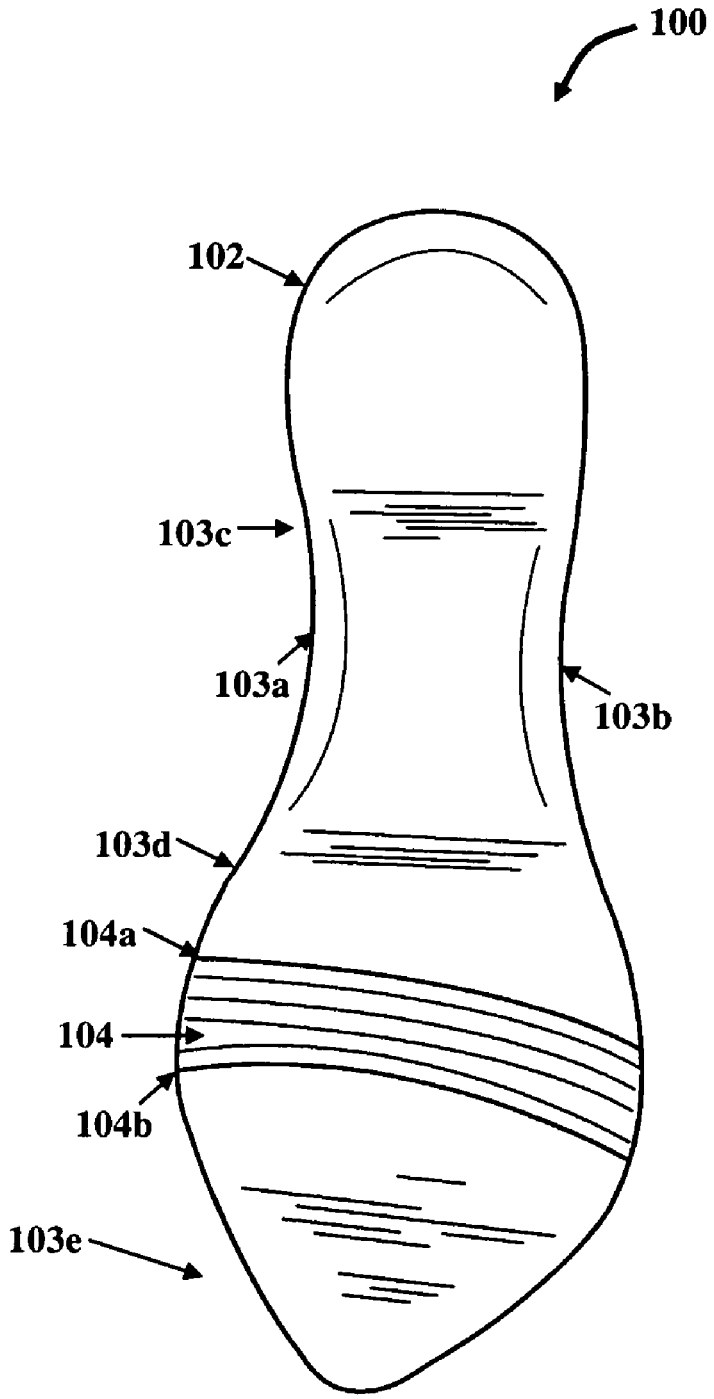
FIG. 9 exemplarily illustrates a bottom view of the flexible contoured footbed insole for use with high heeled footwear.

The flexible contoured footbed insole 100 may further comprise a flexible structure 104 disposed within the support system 103. The flexible structure 104 is disposed at a section 501 between the metatarsal arch support 103*d* and the toe support 103*e* of the support system 103. In an embodiment, the flexible structure 104 may comprise a flexible corrugated or ribbed material. The flexible structure 104 allows the metatarsal arch support 103*d* to flex or pivot about the posterior end 104*a* of the flexible structure 104, and allows the toe support 103*e* to flex or pivot about the anterior end 104*b* of the flexible structure 104. The flexible structure 104 provides flexibility and freedom of movement to the foot 1201. An exploded side view of the flexible contoured footbed insole 100 for use with high heeled footwear illustrating the heel section 102, the first cushioning structure 102*b*, the support system 103, the flexible structure 104, and the second cushioning structure 105 is exemplarily illustrated in FIG. 5. Side views of the flexible contoured footbed insole 100 for use with high heeled footwear illustrating the flexible structure 104 are exemplarily illustrated in FIGS. 6-7. A bottom view of the flexible contoured footbed insole 100 for use with high heeled footwear illustrating the flexible structure 104 is exemplarily illustrated in FIG. 9.

Figure 10:
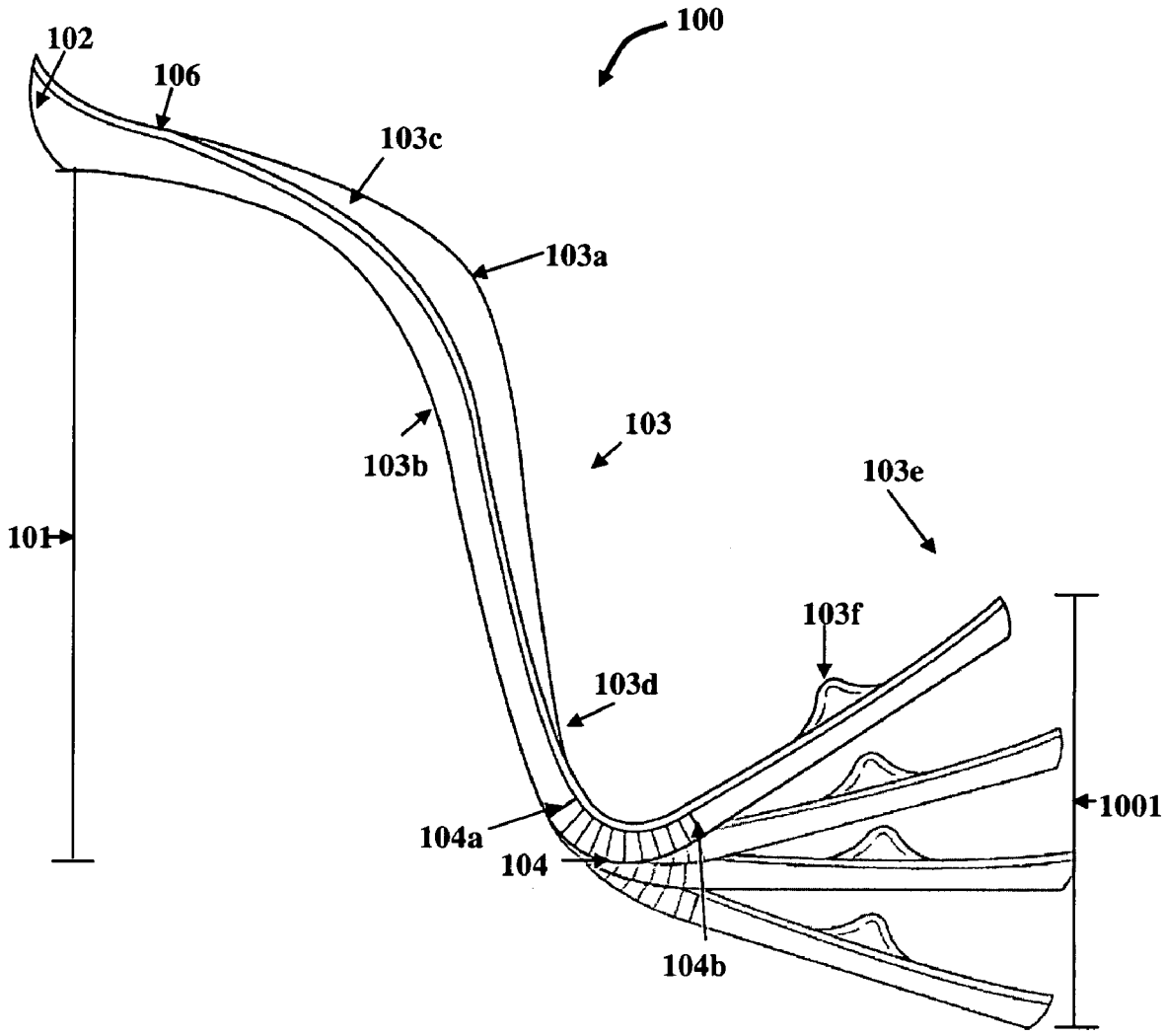
FIG. 10 exemplarily illustrates a side view of the flexible contoured footbed insole for use with high heeled footwear illustrating the flexibility provided by the flexible structure.
Figure 11:
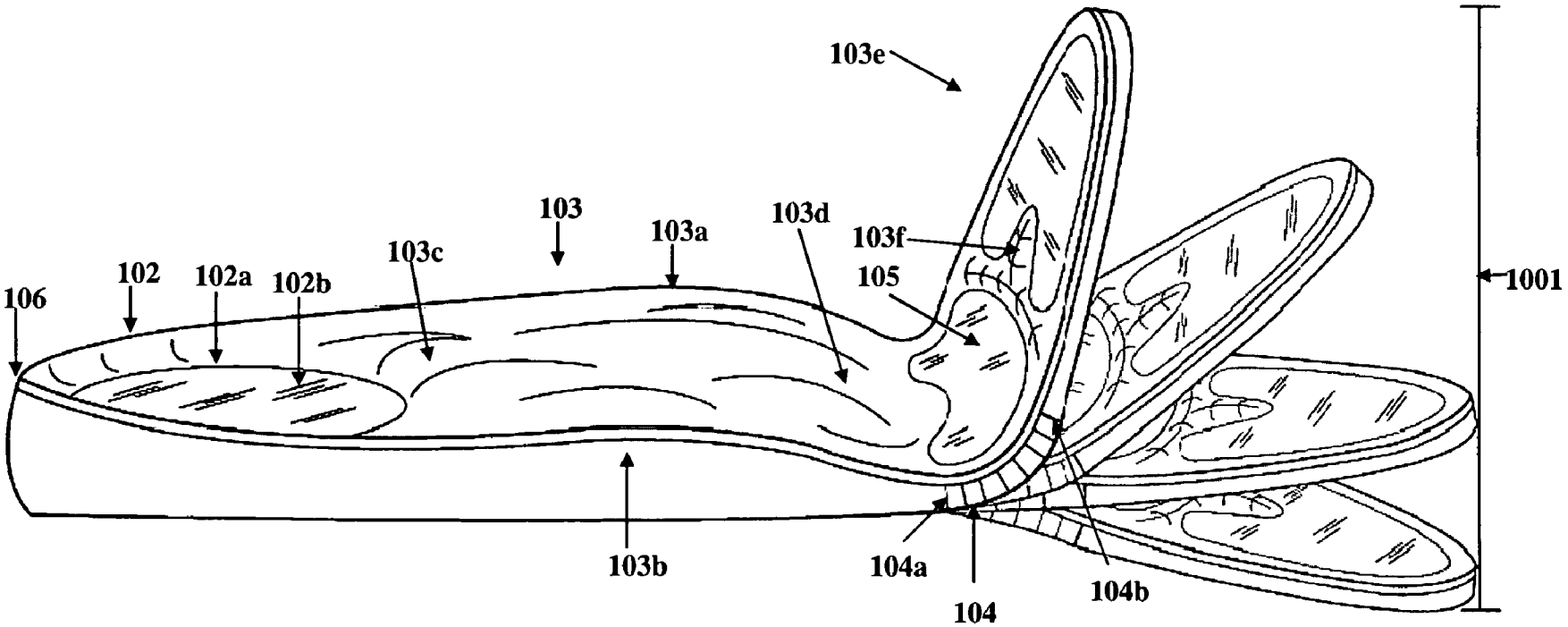
FIG. 11 exemplarily illustrates a side view of the flexible contoured footbed insole for use with flat footwear illustrating the flexibility provided by the flexible structure.

The flexible structure 104 may be located on the flexible contoured footbed insole 100 at an area corresponding to an area 1210 between ball 1208 and waist 1211 of the foot 1201. The flexible structure 104 provides flexibility to the flexible contoured footbed insole 100. The flexible structure 104 provides the flexible contoured footbed insole 100 with a wide range 1001 of motion, as exemplarily illustrated in FIG. 10 and FIG. 11. FIG. 10 exemplarily illustrates a side view of the flexible contoured footbed insole 100 for use with high heeled footwear illustrating the flexibility provided by the flexible structure 104. FIG. 11 exemplarily illustrates a side view of the flexible contoured footbed insole 100 for use with flat footwear illustrating the flexibility provided by the flexible structure 104. The flexible structure 104 therefore enables unrestricted relative motion of the waist 1211 and the heel 1202 of the foot 1201 with the ball 1208 and the toes 1207 of the foot 1201. The flexible structure 104 may be made of an elastomer, for example, rubber, or a thermoplastic polymer, for example, polyvinyl chloride (PVC).

Figure 14:
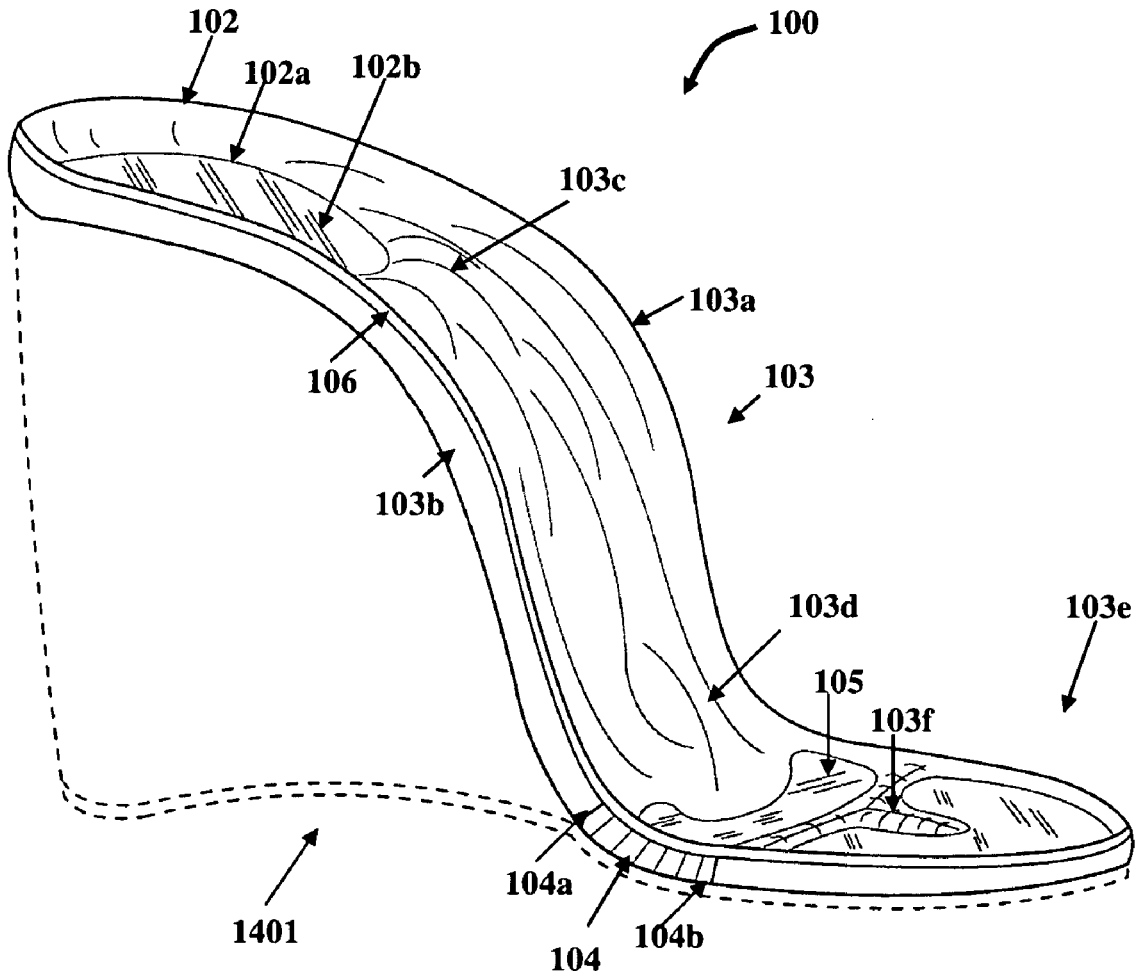
FIG. 14 exemplarily illustrates a flexible contoured footbed insole with the flexible structure used in a wedge high heeled shoe.
Figure 15:
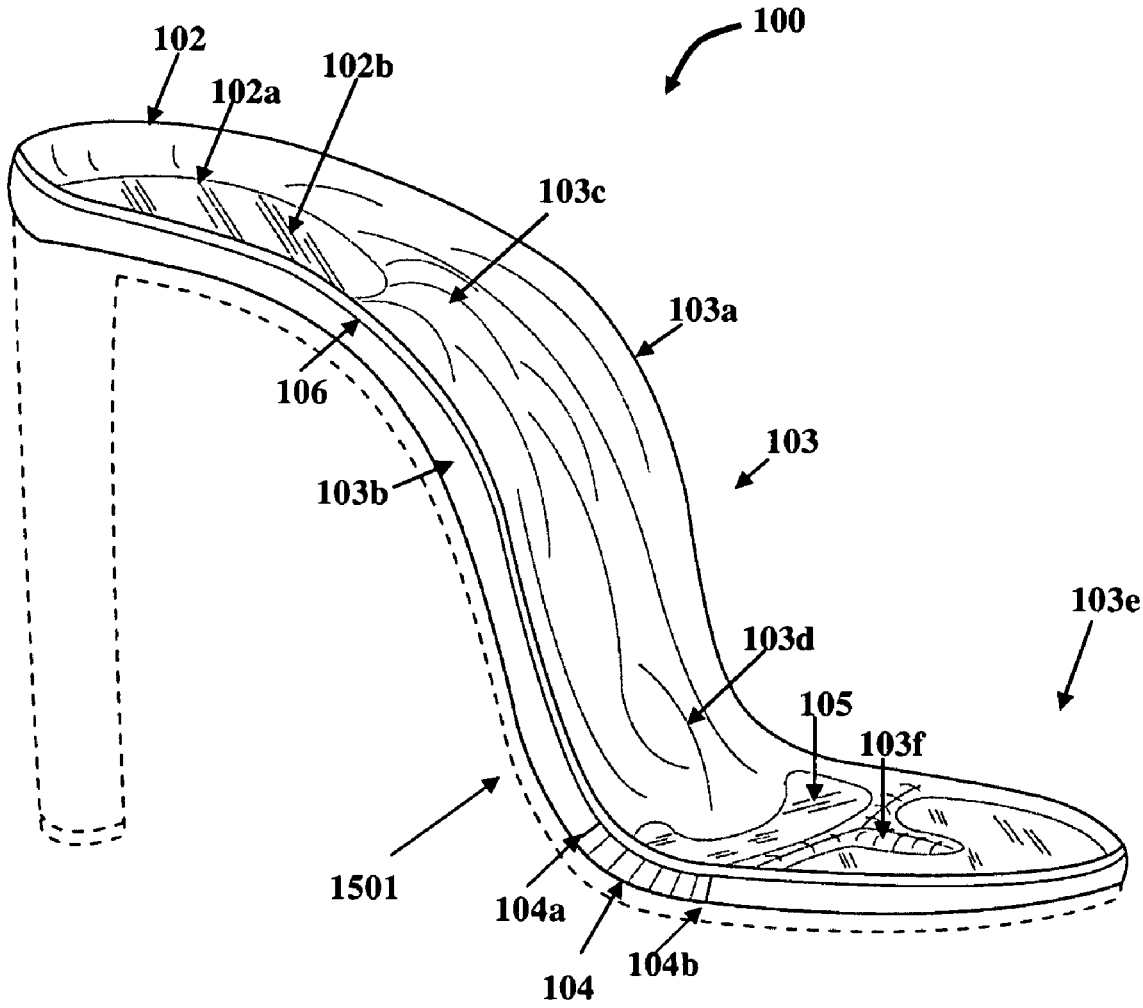
FIG. 15 exemplarily illustrates a flexible contoured footbed insole with the flexible structure used in a high heeled shoe.

The flexible contoured footbed insole 100 may be used with the flexible structure 104 in shoes of different types. For example, the flexible contoured footbed insole 100 with the flexible structure 104 may be used in a wedge high heeled shoe 1401 as exemplarily illustrated in FIG. 14 or may be used in a regular high heeled shoe 1501 as exemplarily illustrated in FIG. 15. The wedge high heeled shoe 1401 and the regular high heeled shoe 1501 are illustrated by dashed lines in FIG. 14 and FIG. 15 respectively.

Figure 16:
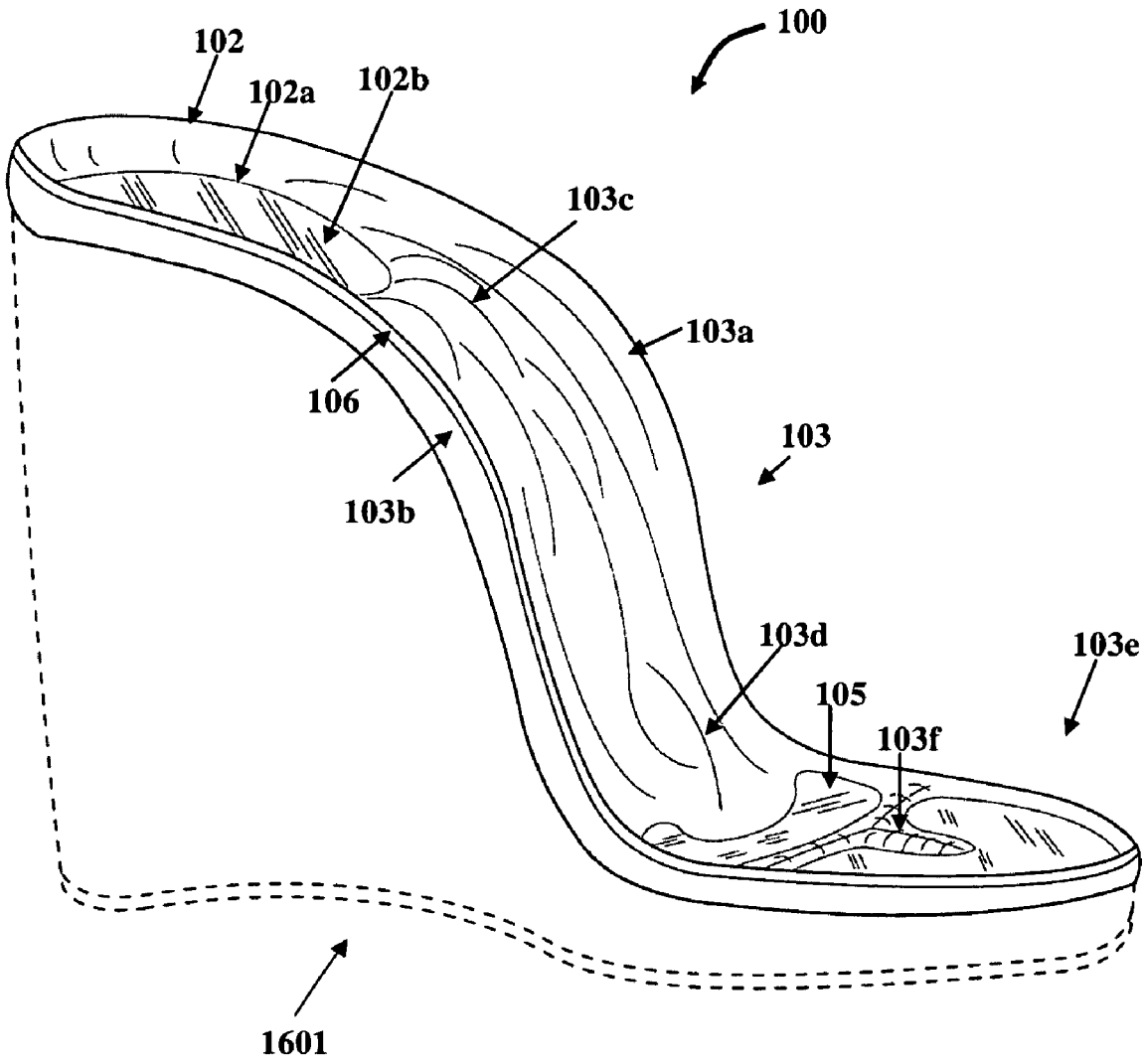
FIG. 16 exemplarily illustrates a flexible contoured footbed insole without the flexible structure used in a platform wedge high heeled shoe.
Figure 17:
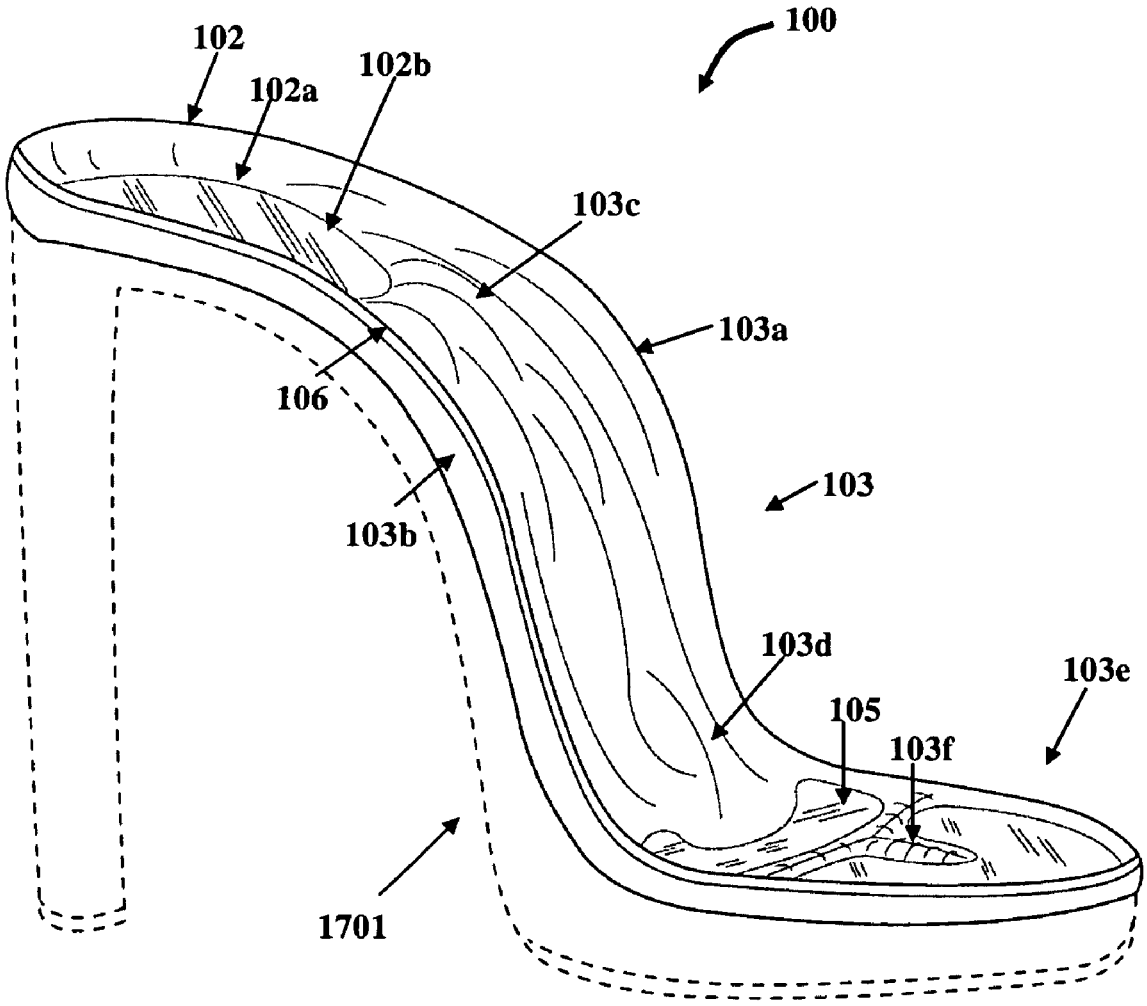
FIG. 17 exemplarily illustrates a flexible contoured footbed insole without the flexible structure used in a platform high heeled shoe.

The flexible contoured footbed insole 100 may also be used without the flexible structure 104 in shoes of different types. For example, the flexible contoured footbed insole 100 without the flexible structure 104 may be used in a platform wedge high heeled shoe 1601 as exemplarily illustrated in FIG. 16 or may be used in a platform high heeled shoe 1701 as exemplarily illustrated in FIG. 17. The platform wedge high heeled shoe 1601 and the platform high heeled shoe 1701 are illustrated by dashed lines in FIG. 16 and FIG. 17 respectively.

A lining 106 may be disposed along the upper surface of the flexible contoured footbed insole 100 for providing a contact surface for the wearer's foot 1201. The lining 106 is a layer of material disposed on the upper surface of the flexible contoured footbed insole 100. The lining 106 may, for example, be a soft suede leather liner. The different components of the flexible contoured footbed insole 100 are disposed below the lining 106. The flexible contoured footbed insole 100 may be made of a moisture absorbing material with a non-slippery surface texture for absorbing moisture produced by the foot 1201. The material of the flexible contoured footbed insole 100 wicks excess moisture away from the foot 1201, thereby ensuring optimal conditions for the foot 1201. The non-slippery surface texture of the flexible contoured footbed insole 100 prevents the foot 1201 from sliding away from a position comfortable to the wearer. The flexible contoured footbed insole 100 may, for example, be made of cork and latex, and covered with a soft suede leather liner. The material may be pliable and compressed under the weight of the wearer, thereby accommodating the unique contours of the individual foot 1201 thus creating a personalized orthotic. The material may be a lightweight material.

FIG. 11 exemplarily illustrates a side view of the flexible contoured footbed insole 100 for use with flat footwear illustrating the flexibility provided by the flexible structure 104. The heel section 102 of the flexible contoured footbed insole 100 for use with flat footwear may not be raised to the height 101. However, the flexible contoured footbed insole 100 may be manufactured with different heights of the heel section 102. The height 101 of the heel section 102 may be chosen by the wearer based on comfort and fashion preferences of the wearer.

Figure 13A:
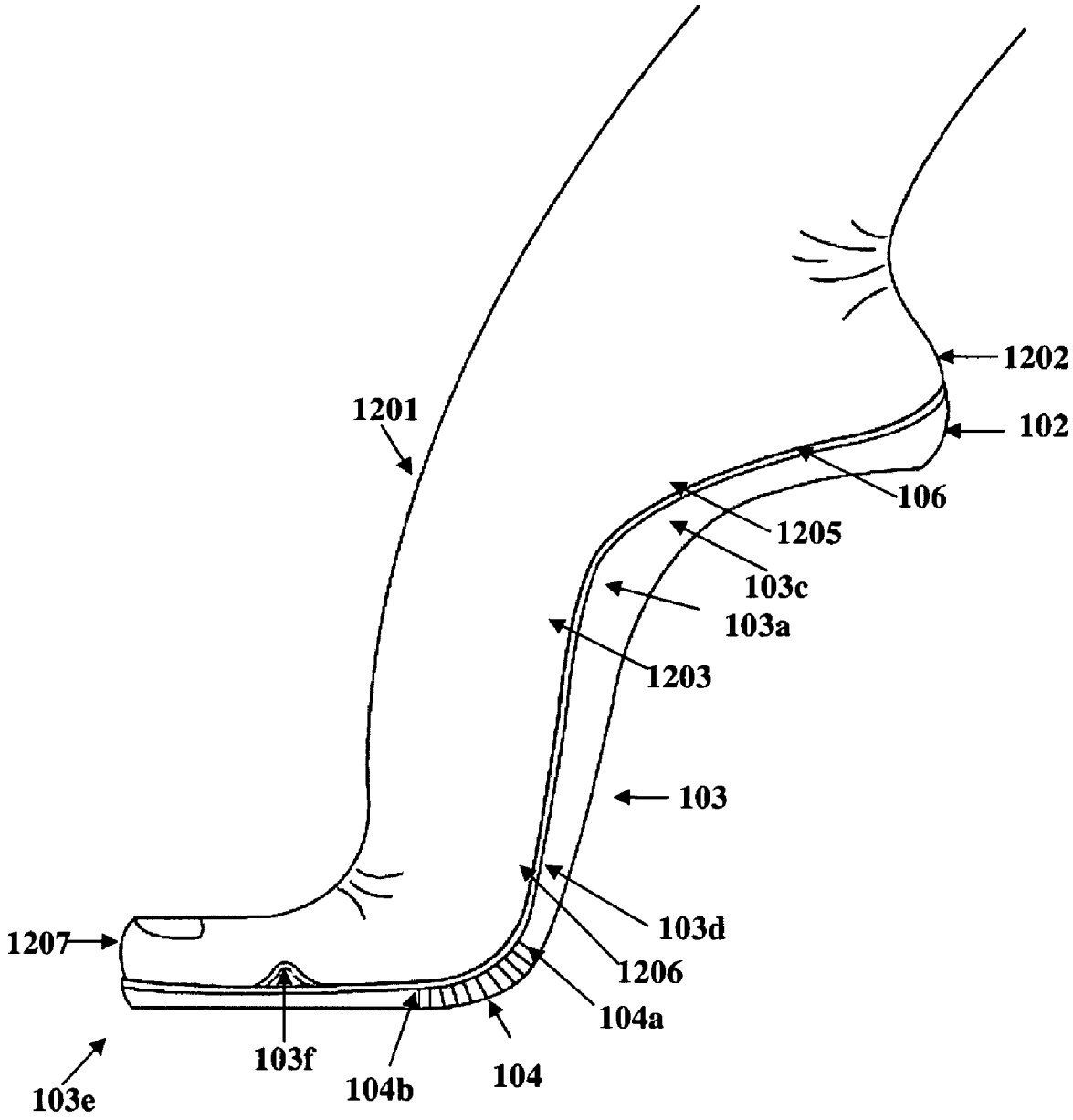
FIG. 13A exemplarily illustrates a side view of the flexible contoured footbed insole for use with high heeled footwear, accommodating the wearer's foot.
Figure 13B:
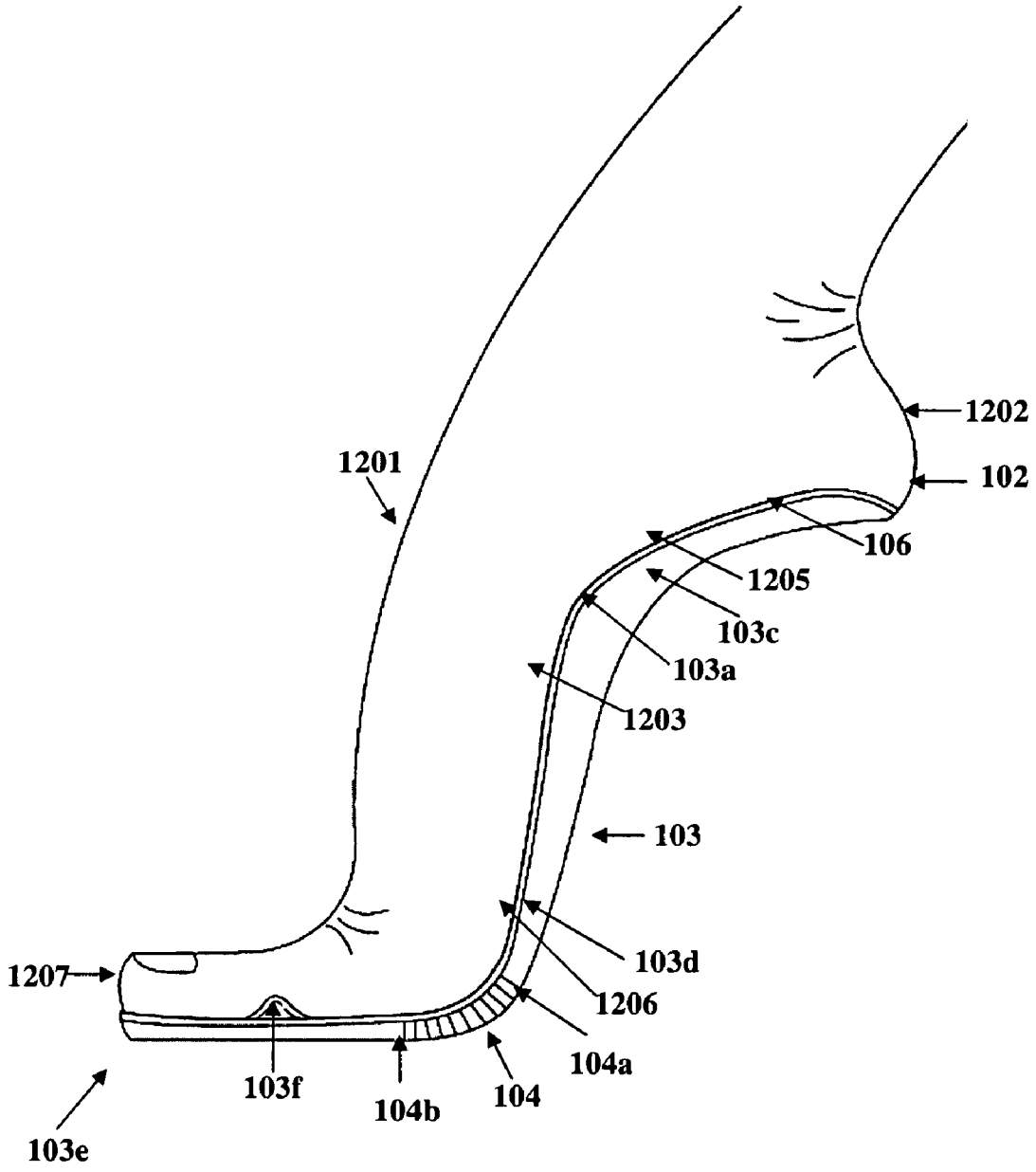
FIG. 13B exemplarily illustrates a side view of the flexible contoured footbed insole for use with high heeled footwear, with an alternative design of the heel section, accommodating the wearer's foot.

FIGS. 13A-13B exemplarily illustrate side views of the flexible contoured footbed insole 100 for use with high heeled footwear accommodating the wearer's foot 1201. The heel section 102 supports the heel 1202 of the wearer's foot 1201. Two different designs of the heel section 102 are exemplarily illustrated in FIGS. 13A-13B. The inner longitudinal arch support 103*a* supports the inner longitudinal arch 1203 of the wearer's foot 1201. The transverse arch support 103*c* supports the transverse arch 1205. The metatarsal arch support 103*d* supports the metatarsal arch 1206. The toe support 103*e* provides support to the toes 1207. The raised toe bar section 103*f* prevents the wearer's foot 1201 from sliding forward while wearing high heeled footwear. The flexible structure

104 provides flexibility and freedom of movement to the wearer's foot 1201. The outer longitudinal arch support 103*b* providing support to the outer longitudinal arch 1204 is not shown in FIGS. 13A-13B.

Figure 18:
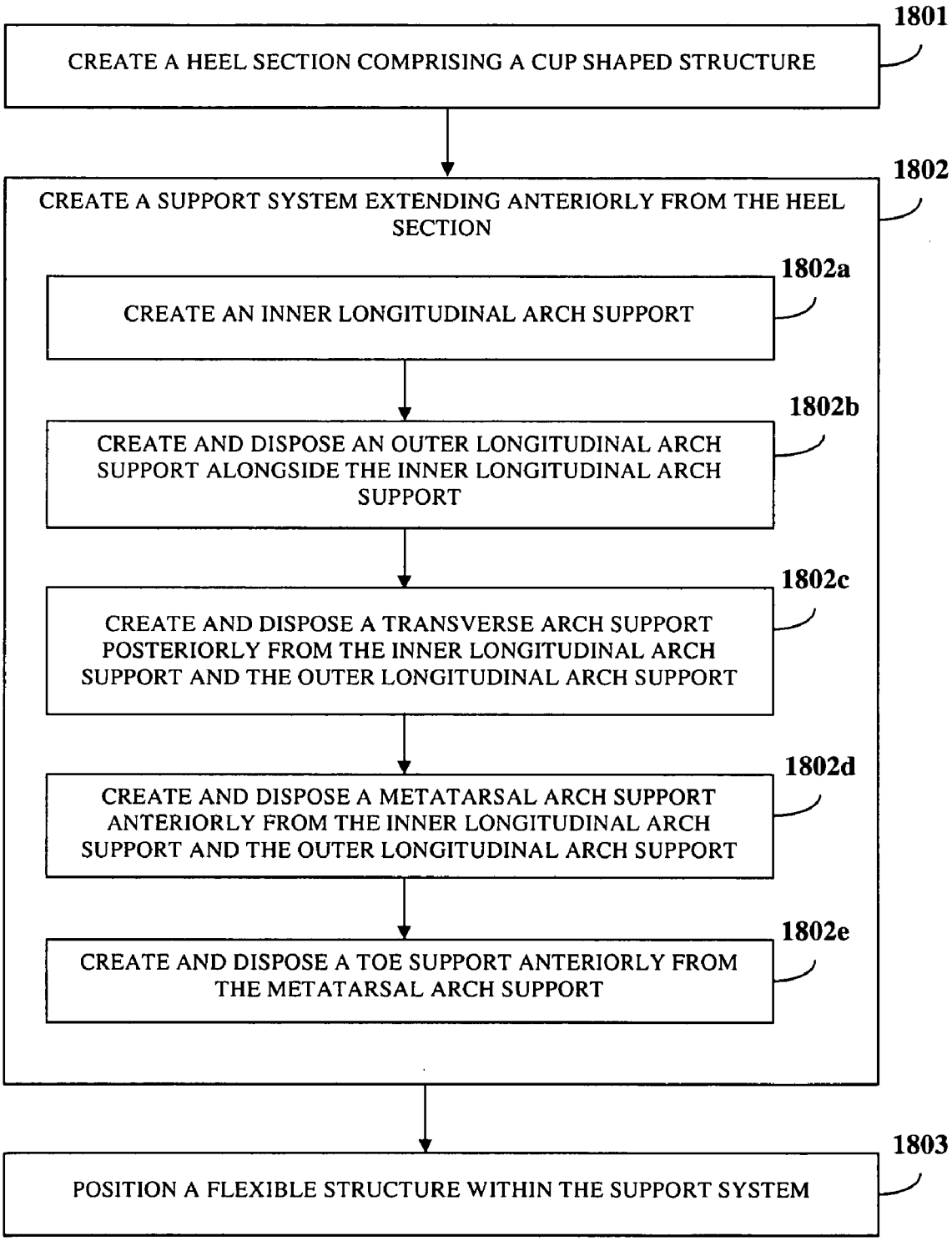
FIG. 18 illustrates a method of manufacturing a flexible contoured footbed insole for footwear for providing an anatomically correct foot support to a wearer of the footwear.

FIG. 18 illustrates a method of manufacturing a flexible contoured footbed insole 100 for footwear for providing an anatomically correct foot support to a wearer of the footwear. A heel section 102 comprising a cup shaped structure 102*a* is created 1801. The heel section 102 is created for accommodating a heel 1202 of the wearer's foot 1201. A first cushioning structure 102*b* may be disposed in the cup shaped structure 102*a* of the heel section 102 for providing comfort and shock absorbance to the heel 1202 of the wearer's foot 1201. A support system 103 extending anteriorly from the heel section 102 is then created 1802. The support system 103 is created for supporting an inner longitudinal arch 1203, an outer longitudinal arch 1204, a transverse arch 1205, a metatarsal arch 1206, and toes 1207 of the wearer's foot 1201.

The support system 103 is created 1802 as follows: An inner longitudinal arch support 103*a* for supporting the inner longitudinal arch 1203 of the wearer's foot 1201 is created 1802*a*. An outer longitudinal arch support 103*b* is created and disposed 1802*b* adjacent to the inner longitudinal arch support 103*a*. The outer longitudinal arch support 103*b* is created for supporting the outer longitudinal arch 1204 of the wearer's foot 1201. A transverse arch support 103*c* is created and disposed 1802*c* posteriorly from the inner longitudinal arch support 103*a* and the outer longitudinal arch support 103*b* for supporting the transverse arch 1205 of the wearer's foot 1201. A metatarsal arch support 103*d* is created and disposed 1802*d* anteriorly from the inner longitudinal arch support 103*a* and the outer longitudinal arch support 103*b*. The metatarsal arch support 103*d* stabilizes the five metatarsal heads of the wearer's foot 1201. A toe support 103*e* is created and disposed 1802*e* anteriorly from the metatarsal arch support 103*d* for supporting the toes 1207 of the wearer's foot 1201. A flexible structure 104 may be positioned 1803 within the support system 103 for providing flexibility and freedom of movement to the foot 1201.

A raised toe bar section 103*f* is created and attached to the toe support 103*e* at a location corresponding to an area 1209 between the ball 1208 and the toes 1207 of the wearer's foot 1201 for preventing the wearer's foot 1201 from sliding forward due to the steep incline of high heeled footwear. A second cushioning structure 105 may be disposed between the metatarsal arch support 103*d* and the toe support 103*e* for providing comfort and shock absorbance to the ball 1208 of the wearer's foot 1201. A lining 106 may be disposed along the upper surface of the flexible contoured footbed insole 100 for providing a contact surface for the wearer's foot 1201. The flexible contoured footbed insole 100 is thereby manufactured for providing the anatomically correct foot support to the wearer of the footwear. The heel section 102 of the manufactured flexible contoured footbed insole 100 may be raised to a height 101 of, for example, 4 inches or more to be used with footwear with heels of a height of 4 inches or more. The manufactured flexible contoured footbed insole 100 for use with high heeled footwear and flat footwear is exemplarily illustrated in FIG. 10 and FIG. 11 respectively.

The foregoing examples have been provided merely for the purpose of explanation and are in no way to be construed as limiting of the present invention. While the invention has been described with reference to various embodiments, it is understood that the words, which have been used herein, are words of description and illustration, rather than words of limitation. Further, although the invention has been described herein with reference to particular means, materials and embodiments, the invention is not intended to be limited to the particulars disclosed herein; rather, the invention extends to all functionally equivalent structures, methods and uses, such as are within the scope of the appended claims. Those skilled in the art, having the benefit of the teachings of this specification, may effect numerous modifications thereto and changes may be made without departing from the scope and spirit of the invention in its aspects.

I claim:

1. A flexible contoured footbed insole for footwear configured to provide an anatomically correct foot support to a wearer of said footwear, comprising:

a heel section comprising a generally concave, cup shaped structure recessed in said heel section to a predetermined depth, said heel section configured to accommodate a heel of a foot of said wearer;

a support system extending anteriorly from said heel section, said support system comprising an inner longitudinal arch support, an outer longitudinal arch support, a transverse arch support, a metatarsal arch support, and a toe support, configured to support an inner longitudinal arch, an outer longitudinal arch, a transverse arch, a metatarsal arch, and toes of the foot of the wearer respectively, wherein the transverse arch support extends posteriorly from the inner longitudinal arch support and said outer longitudinal arch support;

a flexible structure disposed at a section linking said metatarsal arch support and said toe support of said support system, wherein said flexible structure is configured to provide flexibility to the metatarsal arch support to pivot about a posterior end of the flexible structure, and wherein said flexible structure is configured to allow the toe support to pivot about the anterior end of the flexible structure; and wherein said flexible contoured footbed insole is integral to said footwear and is pliable and compressed under the weight of the wearer for accommodating unique contours of the foot of the wearer;

whereby said flexible contoured footbed insole provides said anatomically correct foot support to the wearer of the footwear.

2. The flexible contoured footbed insole of claim 1, wherein the heel section further comprises a first cushioning structure for providing comfort and shock absorbance to said heel of the foot of the wearer, wherein said first cushioning structure is located in said cup shaped structure of the heel section.

3. The flexible contoured footbed insole of claim 1, wherein said outer longitudinal arch support is disposed adjacent to said inner longitudinal arch support, wherein said metatarsal arch support extends anteriorly from the inner longitudinal arch support and the outer longitudinal arch support, wherein said metatarsal arch support is configured to stabilize metatarsal heads of the foot of the wearer, and wherein said toe support extends anteriorly from the metatarsal arch support.

4. The flexible contoured footbed insole of claim 3, further comprising a second cushioning structure provided between the metatarsal arch support and the toe support, wherein said second cushioning structure is configured to provide comfort and shock absorbance to ball of the foot of the wearer.

5. The flexible contoured footbed insole of claim 1, wherein the toe support comprises a raised toe bar section disposed at a location corresponding to an area between ball and the toes of the foot of the wearer, wherein said raised toe bar section is configured to prevent the foot of the wearer from sliding forward due to steep incline of high heeled footwear.

6. The flexible contoured footbed insole of claim 1, further comprising a lining disposed along upper surface of the flexible contoured footbed insole for providing a contact surface for the foot of the wearer.

7. A flexible contoured footbed insole for footwear configured to provide an anatomically correct foot support to a wearer of said footwear, comprising:

a heel section comprising a generally concave, cup shaped structure recessed in said heel section to a predetermined depth, said heel section configured to accommodate a heel of a foot of said wearer;

a support system extending anteriorly from said heel section, comprising:

an inner longitudinal arch support configured to support an inner longitudinal arch of the foot of the wearer;

an outer longitudinal arch support disposed adjacent to said inner longitudinal arch support, and configured to support an outer longitudinal arch of the foot of the wearer;

a transverse arch support extending posteriorly from the inner longitudinal arch support and said outer longitudinal arch support, wherein said transverse arch support is configured to support a transverse arch of the foot of the wearer;

a metatarsal arch support extending anteriorly from the inner longitudinal arch support and the outer longitudinal arch support, wherein said metatarsal arch support is configured to stabilize metatarsal heads of the foot of the wearer;

a toe support extending anteriorly from the metatarsal arch support, wherein said toe support is configured to support toes of the foot of the wearer, and wherein the toe support is disposed anteriorly from the metatarsal arch support; and a flexible structure disposed at a section linking the metatarsal arch support and the toe support of the support system, wherein the flexible structure is configured to provide flexibility to the metatarsal arch support to pivot about a posterior end of the flexible structure, and wherein said flexible structure is configured to allow the toe support to pivot about the anterior end of the flexible structure; and wherein said flexible contoured footbed insole is integral to said footwear and is pliable and compressed under the weight of the wearer for accommodating unique contours of the foot of the wearer.

8. The flexible contoured footbed insole of claim 7, wherein said flexible structure provides flexibility and freedom of movement to the foot of the wearer.

9. A method of manufacturing a flexible contoured footbed insole configured to provide an anatomically correct foot support to a wearer of said footwear, comprising the steps of:

creating a heel section comprising a generally concave, cup shaped structure recessed to a desired depth in said heel section, and configuring said heel section to accommodate a heel of a foot of said wearer;

creating a support system extending anteriorly from said heel section, said support system comprising an inner longitudinal arch support, an outer longitudinal arch support, a transverse arch support, a metatarsal arch support, and a toe support, configured to support an inner longitudinal arch, an outer longitudinal arch, a transverse arch, a metatarsal arch, and toes of said foot of the wearer respectively, wherein the transverse arch support extends posteriorly from the inner longitudinal arch support and said outer longitudinal arch support;

positioning a flexible structure at a section linking said metatarsal arch support and said toe support of said support system, wherein said flexible structure is configured to provide flexibility to the metatarsal arch support to pivot about a posterior end of the flexible structure, and wherein said flexible structure is configured to allow the toe support to pivot about the anterior end of the flexible structure; and wherein said flexible contoured footbed insole is integral to said footwear and is pliable and compressed under the weight of the wearer for accommodating unique contours of the foot of the wearer;

whereby said flexible contoured footbed insole is manufactured for providing said anatomically correct foot support to the wearer of the footwear.

10. The method of claim 9, further comprising the step of disposing a lining along upper surface of the flexible contoured footbed insole for providing a contact surface for the foot of the wearer.

11. The method of claim 9, further comprising the step of disposing a first cushioning structure in said cup shaped structure of the heel section for providing comfort and shock absorbance to said heel of the foot of the wearer.

12. The method of claim 9, wherein said step of creating said support system comprises the steps of:

disposing said outer longitudinal arch support adjacent to said inner longitudinal arch support;

disposing said metatarsal arch support anteriorly from the inner longitudinal arch support and the outer longitudinal arch support, and configuring said metatarsal arch support to stabilize metatarsal heads of the foot of the wearer; and disposing said toe support anteriorly from the metatarsal arch support.

13. The method of claim 12, further comprising the step of creating a raised toe bar section and attaching said raised toe bar section to said toe support at a location corresponding to an area between ball and the toes of the foot of the wearer, and configuring said raised toe bar section to prevent the foot of the wearer from sliding forward due to steep incline of high heeled footwear.

14. The method of claim 12, further comprising the step of disposing a second cushioning structure between the metatarsal arch support and the toe support for providing comfort and shock absorbance to ball of the foot of the wearer.

15. A flexible contoured footbed insole for footwear for providing an anatomically correct foot support to a wearer of said footwear, comprising:

a heel section comprising a generally concave, cup shaped structure recessed in said heel section to a desired depth for accommodating a heel of a foot of said wearer;

a support system extending anteriorly from said heel section, said support system comprising contoured supports configured to support an inner longitudinal arch, an outer longitudinal arch, a transverse arch, a metatarsal arch, and toes of said foot of the wearer; and a flexible structure disposed at a section linking said metatarsal arch support and said toe support of said support system, wherein said flexible structure is configured to provide flexibility to the metatarsal arch support to pivot about a posterior end of the flexible structure, and wherein said flexible structure is configured to allow the toe support to pivot about the anterior end of the flexible structure;

whereby said flexible contoured footbed insole provides said anatomically correct foot support to the wearer of the footwear.

* * * * *